US008083366B1

(12) United States Patent
Backer

(10) Patent No.: US 8,083,366 B1
(45) Date of Patent: Dec. 27, 2011

(54) INTERNALLY ILLUMINATED EXTRUSION ARCHITECTURE

(75) Inventor: Bruce Everett Backer, San Diego, CA (US)

(73) Assignee: Insta-Group US, Inc., San Diego, CA (US)

( * ) Notice: Subject to any disclaimer, the term of this patent is extended or adjusted under 35 U.S.C. 154(b) by 491 days.

(21) Appl. No.: 12/396,805

(22) Filed: Mar. 3, 2009

Related U.S. Application Data

(60) Provisional application No. 61/068,536, filed on Mar. 7, 2008.

(51) Int. Cl.
*F21S 6/00* (2006.01)

(52) U.S. Cl. ..... 362/145; 362/147

(58) Field of Classification Search ..... 362/145, 362/147

See application file for complete search history.

(56) References Cited

U.S. PATENT DOCUMENTS

| | | | | |
|---|---|---|---|---|
| 3,224,823 | A * | 12/1965 | Schulze | 312/108 |
| 3,934,365 | A | 1/1976 | Stein | |
| 4,325,197 | A | 4/1982 | Achten et al. | |
| 4,785,565 | A | 11/1988 | Kuffner | |
| 4,821,787 | A | 4/1989 | Swanson | |
| 4,998,189 | A | 3/1991 | Guggemos | |
| 5,191,501 | A | 3/1993 | Blau | |
| 5,426,573 | A | 6/1995 | Jenkins | |
| 5,537,766 | A | 7/1996 | Nickens | |
| 5,584,566 | A | 12/1996 | Bowman | |
| 5,915,855 | A | 6/1999 | Murase | |
| 6,553,724 | B1 | 4/2003 | Bigler | |
| 6,736,075 | B2 | 5/2004 | Jackson | |
| 2002/0095842 | A1 | 7/2002 | Wenz et al. | |
| 2005/0210725 | A1 | 9/2005 | Stolls | |
| 2005/0265019 | A1 | 12/2005 | Sommers | |
| 2006/0230990 | A1 | 10/2006 | Buckner | |
| 2007/0165421 | A1 | 7/2007 | Sakai | |
| 2007/0195535 | A1 | 8/2007 | Artwohl | |
| 2007/0273966 | A1 | 11/2007 | Chen | |
| 2008/0094824 | A1 | 4/2008 | Stack et al. | |
| 2008/0094834 | A1 | 4/2008 | Li | |
| 2008/0151531 | A1 | 6/2008 | Richardson | |
| 2008/0151560 | A1 | 6/2008 | Chang | |

FOREIGN PATENT DOCUMENTS

| | | |
|---|---|---|
| JP | 10225348 | 8/1988 |
| JP | 2005345548 | 12/2005 |
| JP | 2006071748 | 3/2006 |
| JP | 2006154203 | 8/2006 |

* cited by examiner

*Primary Examiner* — David V Bruce
(74) *Attorney, Agent, or Firm* — Virginia P. Shogren

(57) ABSTRACT

Internally illuminated extrusion architecture comprising a plurality of internally illuminated extrusion-based modular members capable of being connected to form a display structure uniformly radiating diffused light from its interior spaces. A continuous glowing lighted effect emanating from the structural components of the architecture draws the attention of a viewer. Members of varied shape and lengths accommodate different scale structures and foot-prints. T-guides integral to the extrusion-based members allow for unique customization through incorporation of banners, fabric sheets, large scale graphics, shelf assemblies, panels, fascia attachments, skin attachments, headers, canopies, bars, storage towers, tables, and/or workstations at any desired point along the longitudinal axis of the members.

19 Claims, 17 Drawing Sheets

2

INTERNALLY ILLUMINATED EXTRUSION ARCHITECTURE

CROSS REFERENCE TO RELATED APPLICATIONS

This application claims priority under 35 USC 119(*e*) of Provisional Patent Application Ser. No. 61/068,536 filed Mar. 7, 2008, entitled "Internally Illuminated Modular Display Architecture and Structures" which is hereby incorporated by reference in its entirety.

FIELD OF THE INVENTION

This invention relates generally to modular architecture, and more particularly to internally illuminated modular display architecture constructed with a plurality of members incorporating light into the structural design to produce an overall continuous glowing effect to a viewer of the architecture. The glowing architecture may be utilized to draw the attention of passers by to particular goods or services being promoted at trade shows, exhibitions, conventions, retail environments, corporate office interiors, airports, museums, public spaces, and the like.

BACKGROUND OF THE INVENTION

Trade shows and other large exhibitions are routinely held in large, open building spaces with high ceilings and poor sound quality. Creating an appealing environment in convention halls, stadiums, and other large locations is a challenge. Trade show visitors are prone to walking by exhibits without stopping, only glancing at a company's promotions as they pass by.

Despite these drawbacks, trade shows are increasingly popular amongst marketers for providing a targeted audience. Persons who come to a particular trade show are typically drawn by a serious interest in the trade show subject matter or are industry leaders looking for the next best service or goods. The trade shows typically last for days, and the competition is intense amongst exhibitors. The cost to companies attending the trade shows is also relatively high; consequently, the companies seek to generate as much meaningful contact with visitors as possible to recoup their costs of attendance.

One of the primary concerns of trade show exhibitors is creating an eye-catching display that also draws a visitor in to speak with company representatives. Too much lighting can be distracting or off-putting to weary trade show visitors, whereas dark or overly simple exhibits do not attract attention. Trade show visitors also may seek a place to sit down, but do not want to feel penned in by an exhibit. Quieter settings may also be welcoming to visitors, but a closed room would cut off the energy and action felt from other exhibitors.

In the past, these issues have been addressed through various forms of modular displays and lighting systems. For example, some trade show exhibitors use graphic light boxes. Graphic light boxes typically consist of a framed poster-like back lit sheet. There are many limitations to graphic light boxes. The drawbacks include their set shape and dimensions; their inability to be used for structural purposes to support a live load or other aspects of a display; their inability to be structurally integrated within a larger display, and their resulting physical and visual separation from the other aspects and modules within a display.

Accordingly, there is a need in the art for a modular system that: 1) can form the structural component of a display and act as the architecture for the display itself, including providing support for live loads if desired; 2) provides unusual dramatic lighted effect to draw the attention of passers by that is not overly bright and off-putting to the casual observer; 3) incorporates continuous lighting into the structural design for overall continuity of a glowing effect to the viewer of the display; 4) accommodates both large and small-scale structures, including structures of varying foot-prints, such as generally rectangular, generally square, asymmetrical, curved and linear footprints; 5) is sufficiently modular to allow the exhibitor to be creative and create a dramatic new look to the display to set the exhibitor apart from the competition; 6) is capable of combining lighting systems with the structural support for elements of a display; and, 7) is not overly complicated for the typical exhibitor to install, dismantle, reconfigure, transport, and maintain.

SUMMARY OF THE INVENTION

The inventive internally illuminated extrusion architecture comprises a plurality of modular internally illuminated structural members of varied lengths connected to form a display structure. Each of said members comprises a linear extrusion having a defined length and generally rectangular-shaped spaced left and right side walls, each of said side walls having a bottom edge and an upper margin. The side walls are joined along their bottom edges by a center base wall to form a generally rectangular U-shaped opening defining an interior space. Opposed inverted T-guides integral to the upper margins of the side walls extend laterally into the interior space. Opposed cross clips, groove openings, internal T-guides, and external T-guides integral to the side walls extend laterally into the interior space. Opposed spaced L-brackets integral to the base wall extend into the interior space. A lighting fixture is mounted within the interior space, and a bulb is mounted within the fixture. A generally planar cover spans the U-shaped opening proximate the upper margins of the side walls. Opposed edges of the cover are retained within the groove openings. At least a portion of the cover has a diffusion coefficient sufficient to allow light generated by the lighting fixture and bulb when powered to radiate through the cover. Each of the T-guides, clips, groove openings, L-brackets and cover runs the length of the extrusion.

The internally illuminated architecture comprises a plurality of the internally illuminated extrusion-based members connected to form a desired structure which may be used for any desired purpose, including temporary housing of persons promoting goods and services at trade shows.

A method for constructing the internally illuminated architecture comprises the steps of: connecting the extrusion-based members to form a desired structure; mounting the covers; and, providing electric power to the lighting fixtures. The method may further comprise the steps of attaching at least one post member to a base plate; connecting an electric cord between the light fixtures; tucking the cords inside a wire management tube, and attaching any desired custom features to the members, including without limitation, banners, fabric sheets, large scale graphics, shelf assemblies, panels, fascia attachments, skin attachments, headers, canopies, bars, storage towers, tables, and/or workstations.

DETAILED DESCRIPTION OF THE ILLUSTRATIVE EMBODIMENT

Figure 1A:
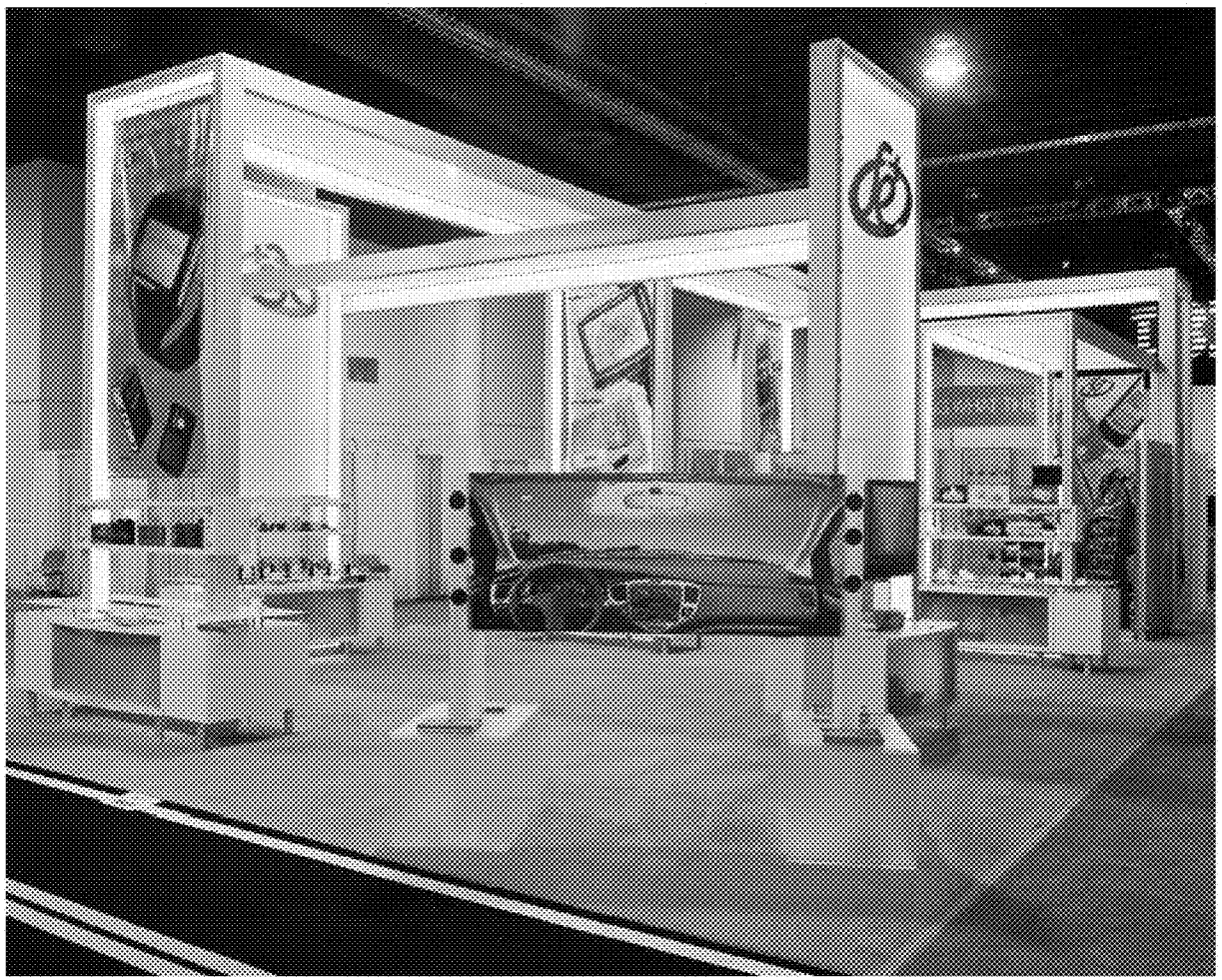
FIG. 1A is a color photograph of an exemplary internally illuminated structure with diffused light radiating from internal spaces, according to the invention.

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the diagrams show in schematic, or omit, parts that are not essential in that diagram to a description of a particular feature, aspect or principle of the invention being disclosed. Thus, the best mode embodiment of one feature may be shown in one diagram, and the best mode of another feature will be called out in another diagram.

In general, the Internally Illuminated Extrusion Architecture of this application comprises a plurality of structural, extrusion-based internally illuminated members capable of being securely connected to other similar members to form a structural form of architecture continuously radiating light from its interior spaces. The internally illuminated architecture formed by a plurality of members provides an unusual glowing lighted effect to the structural components of an exhibit, as well as to particular marketing information or products on display. The glowing effect is sufficient to draw the attention of passers by while not being overly bright and off-putting to the casual observer. An internal lighting fixture is integral to each structural member and provides for visual continuity of the effect. The members are of varying shape and lengths to accommodate both large and small-scale architectural structures, including structures having rectangular, square and linear foot-prints. The illuminated architectural members may be load bearing (i.e., capable of supporting a live load comprising a plurality of other internally illuminated structural members) and may be connected in infinite combinations, thereby allowing an exhibitor to display a creative structural design and create a dramatic new look to set the exhibitor apart from the competition. The members are further simple to install, dismantle, reconfigure, transport, and maintain.

The illuminated members are versatile and can be used in an infinite number of structural designs given unique guides, grooves and brackets integral to the extrusion walls. Each of the guides, clips and brackets runs the length of the extrusion, allowing for mounting of banners, fabric sheets, large scale graphics, fascia, shelving, and various display fixtures at any desired points along the longitudinal axis. Stemming from the unique extrusion member is a multitude of possible structures that may be used for any desired purpose, including defining a space in which persons may meet and talk about products and services.

Internally Illuminated Extrusion Architecture

Figure 1B:
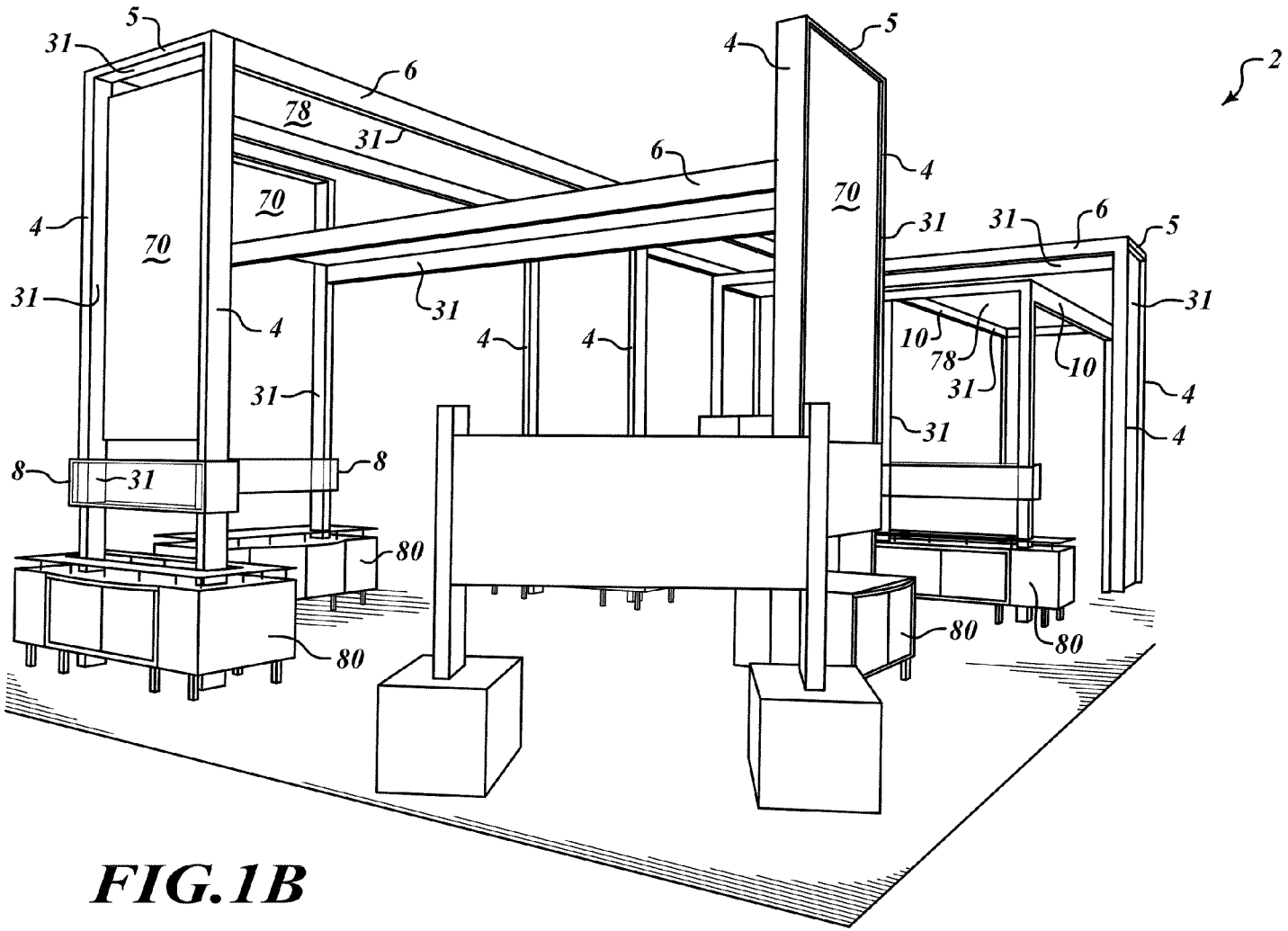
FIG. 1B is a perspective view drawing of the same exemplary internally illuminated structure shown in FIG. 1A, according to the invention.

FIGS. 1A and 1B show an exemplary internally illuminated architectural structure 2, according to the invention. The structure 2 comprises a plurality of vertically and horizontally oriented combinations of posts 4, corner assemblies 5, ceiling spans 6, and beams 10. The structure 2 shown in FIGS. 1A and 1B could be utilized to invitingly fill a tradeshow or convention space according to the invention. The complete length of the structural members 4, 5, 6 and 10 of the architecture 2 give off a continuous uniform glowing effect 31 resulting from an internal illumination system (shown in FIGS. 2A through 3B). The glowing effect 31 acts to draw the attention of passers by without being unduly bright or offensive to the eye. The structure 2 may be designed to have a significant vertical height, such as 16 feet, much greater than typical ceiling heights. The tall structures 2 physically and visually fill the space between the limited trade show floor foot-print and the high ceilings of large buildings, thereby providing an increased dramatic effect.

As shown in FIGS. 1A and 1B, the structure 2 may be constructed with singular beams 10 or dual, spaced, parallel ceiling spans 6 with stretched fabric sheets 78 or other sheet-like inserts that may span up to approximately 20 feet. The ceiling spans 6 or beams 10 linked with stretched fabric sheets 78 help control acoustics, help block overly bright or excessive lighting from above, provide trails for wire management, and give a sense of connection, privacy and dramatic effect to the structure 2. Alternately, the structure 2 may be designed with minimal use of overhead beams 10 or ceiling spans 6 to form a more open exhibit for occupants and visitors. In either event, the structure 2 may be used to define a foot print of space in which person(s) may linger, meet, talk and view products and product literature. Alternately, the defined space could be utilized in a retail environment, corporate office interiors, airports, museums, public spaces, and the like. The structure 2 may be constructed at any desired location and will emit a glowing appearance upon the supply of electric power to the lighting system.

As shown in FIGS. 1A and 1B, and as further discussed in connection with FIGS. 5A-H and FIG. 9, the architecture 2 may be customized with banners 70, fabric sheets 78, including large scale graphics that are either back lit or edge lit, shelving units 8, and storage units 80 of any desired color, shape and design to provide a unique appearance to the structure 2. Computers, computer screens, and other audio-visual technology (not shown) also may be incorporated into the structure 2.

The architecture 2 further provides options for versatile foot-prints. Structures may be linear and have a small footprint, or may be constructed to have a much larger foot-print where desired. The architecture 2 can anchor any exhibit size. The architecture 2 is typically used in "island" exhibits (20 feet by 20 feet and larger); however, it also may be utilized to form structures with footprints of 10×20 feet, 40×60 feet, and combinations in between, including structures having asymmetrical and curved footprints.

Figure 2A:
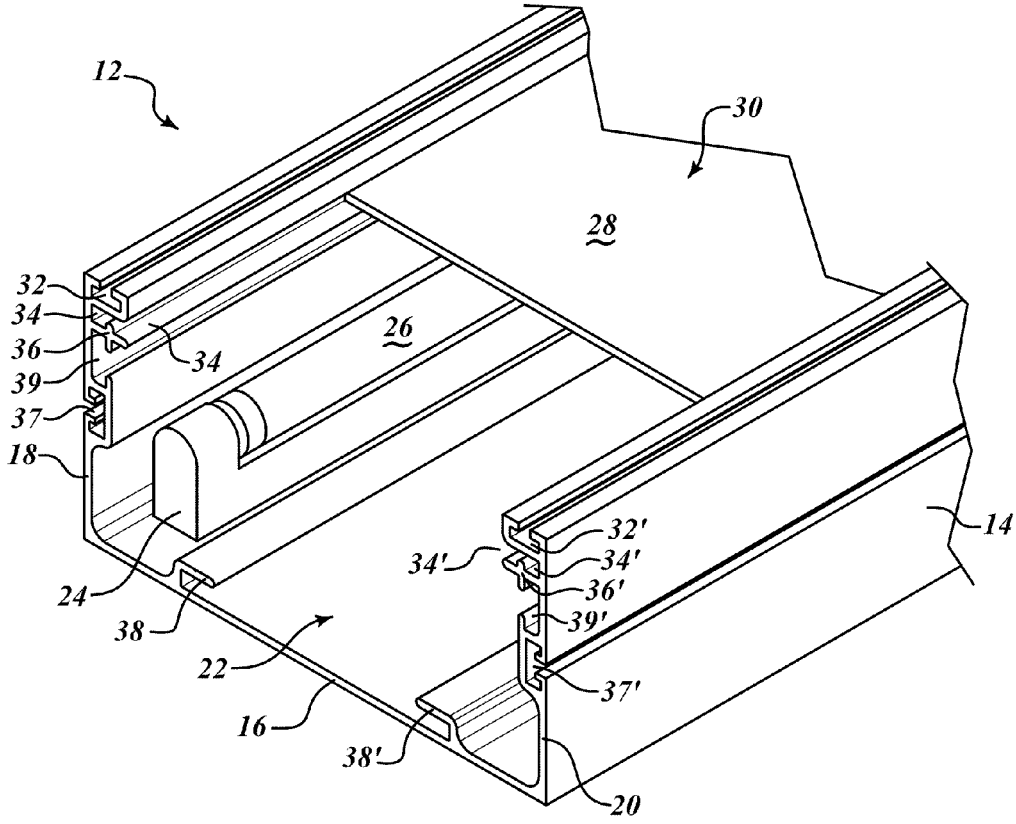
FIG. 2A is a partial perspective view diagram of an internally illuminated structural member with cover slid away from the viewer revealing a partial view of an internally mounted light fixture, according to the invention.

FIG. 2A shows a partial perspective view diagram of an internally illuminated structural member 12 with cover 28 partially slid away from the direction of the viewer revealing a partial view of an internally mounted light fixture 24 and bulb 26, according to the invention. A plurality of the structural members 12 are utilized as posts 4, corner assemblies 5, spans 6 and beams 10 to form structures 2 such as that shown in FIGS. 1A and 1B.

The structural member 12 of FIG. 2A comprises a three-sided metal extrusion 14 having a base 16, and opposed left and right side walls 18, 20. In the preferred embodiment, the extrusion 14 is constructed of an aluminum alloy; however, it may be constructed of any suitable metal, metal alloy, plastic, plastic composite, other rigid material, or combination thereof. The extrusion 14 also may be painted or powder coated for a custom finish for use in custom designs.

As shown in FIG. 2A, the three walls of the extrusion 14 form a generally U-shaped opening defining an interior space 22. A lighting fixture 24 is shown mounted proximate the left side margin of the U-shaped opening 22, and a fluorescent light bulb 26 is mounted in the fixture 24. In the preferred embodiment, the fixture 24 is mounted to one side of the U-shaped opening 22 so as to leave room for wire management (discussed in connection with FIGS. 3A and 3B). However, the fixture 24 may be mounted at any suitable or desired position within the extrusion 14. The preferred embodiment of the extrusion 14 is generally rectangular in cross-section with an 8" wide base wall 16 and 4" high side walls 18, 20. However, any suitable cross-sectional shape and/or size of extrusion 14 may be utilized, including without limitation, extrusions having a square, rectangular, triangular and/or curved cross-sectional shape, and extrusions of varying lengths and widths.

Referring to FIG. 2A, the extrusion 14 comprises opposed inverted T-guides 32, 32' formed within the upper margins of the side walls 18, 20. The T-guides have their respective openings at the base of the inverted "T" facing the top of the extrusion 14. Directly below the inverted T-guides 32, 32' are opposed cross-shaped clips 36, 36' extending laterally into the interior opening 22 of the extrusion 14. Opposed groove openings 34, 34' are defined by the base of the inverted T-guides 32, 32', on the one hand, and cross clips 36, 36', on the other hand. Beneath the cross clips 36, 36' are opposed internal T-guides 39, 39' formed in the sides of the left and right walls 18, 20 with their opening at the base of the "T" facing internally. Below the internal T-guides 39, 39' are opposed external T-guides 37, 37' also formed in the left and right side walls 18, 20, with the opening at the base of the "T" facing externally.

Finally, the base wall 16 comprises two integral opposed, spaced, L-shaped brackets 38, 38' with the short side of the "L's" extending from the base 16 into the internal space 22 of the extrusion 14, and the long sides of the "L's" pointing towards each other. While FIG. 2A shows the preferred embodiment for the shape, position and size of the various T-guides, clips, brackets, and groove openings, it should be understood that any suitable or desired number, shape or positioning of guides, clips, brackets and/or openings may be utilized.

Referring to FIG. 2A, an acrylic cover 28 spans the U-shaped opening 22 at the upper margins of the side walls 18, 20. As further discussed in connection with FIGS. 4A-C, the longitudinal opposed margins of the cover 28 are mounted into the opposed groove openings 34, 34' formed within the right and left side walls 18, 20. As shown in FIG. 2A, the cover 28 may be slid away from the end of the extrusion 14 to reveal a partial view of the internal lighting system 24, 26. The cover 28 is sufficiently diffuse to allow light to pass through it.

In the preferred embodiment, the cover 28 is constructed of acrylic plastic, is approximately 6.5 inches wide, and is approximately 0.125 inches thick. In the preferred embodiment, the cover 28 is continuous along the length of the extrusion 14 once inserted therein, and has no openings defined therein except where necessary to attach custom features, an example of which is shown and discussed in connection with FIG. 5A. Alternately, the cover 28 may be constructed of any suitable or desirable plastics, including polystyrenes, fabrics, perforated material, composites or combinations thereof, and may include openings, materials of differing thicknesses (to alter the diffusion characteristics), and/or may include varying materials having different coefficients of diffusion.

In addition, while the preferred embodiment comprises a fluorescent light fixture 24 and bulb 26 mounted along the longitudinal axis inside each structural member 12, any suitable or desired number of light fixtures and bulbs (including different colored bulbs and/or different types of bulbs, e.g., fluorescent, LED, spot lights) may be utilized to create the internally glowing effect 31 of the present invention.

Various dimensions of florescent light fixtures 24 are utilized in structural members 12 of varying lengths. The light fixtures 24 for horizontally-oriented members 12 range from 4, 5, 7 and 8 feet in width. Fixtures 24 in vertically-oriented members 12 range from 8 to 12 to 16 feet in height. The preferred fixtures 24 are linkable T5 low-profile fluorescents. While florescent fixtures 24 are most commonly preferred, light emitting diodes (LEDs), spot lights, different types and shapes of fluorescents and any combination thereof may be utilized. For example, LEDs may be utilized along curves or positioned inside the slots formed by one or more external T-guides. Colored bulbs and/or colored covers 28 also may be utilized to provide different effects.

The fixtures 24 are linkable and are run in a chain through connected members 12. Wires from separate chains of fixtures 24 are combined in a wire management tube 74 (shown in FIGS. 3A and 3B) and connected end to end via male/female plugs. At the base of one or more of the members 12, proximate where the base comes into contact with a floor, a multi-outlet power strip is provided to power the lead male electrical plug and any other electrical devices utilized in the structure 2. The power strip is, in turn, typically connected to an extension cord running from main outlets in the building housing the structure 2. Alternately, the structure 2 could be constructed outside with power provided via extension cords.

Figure 2B:
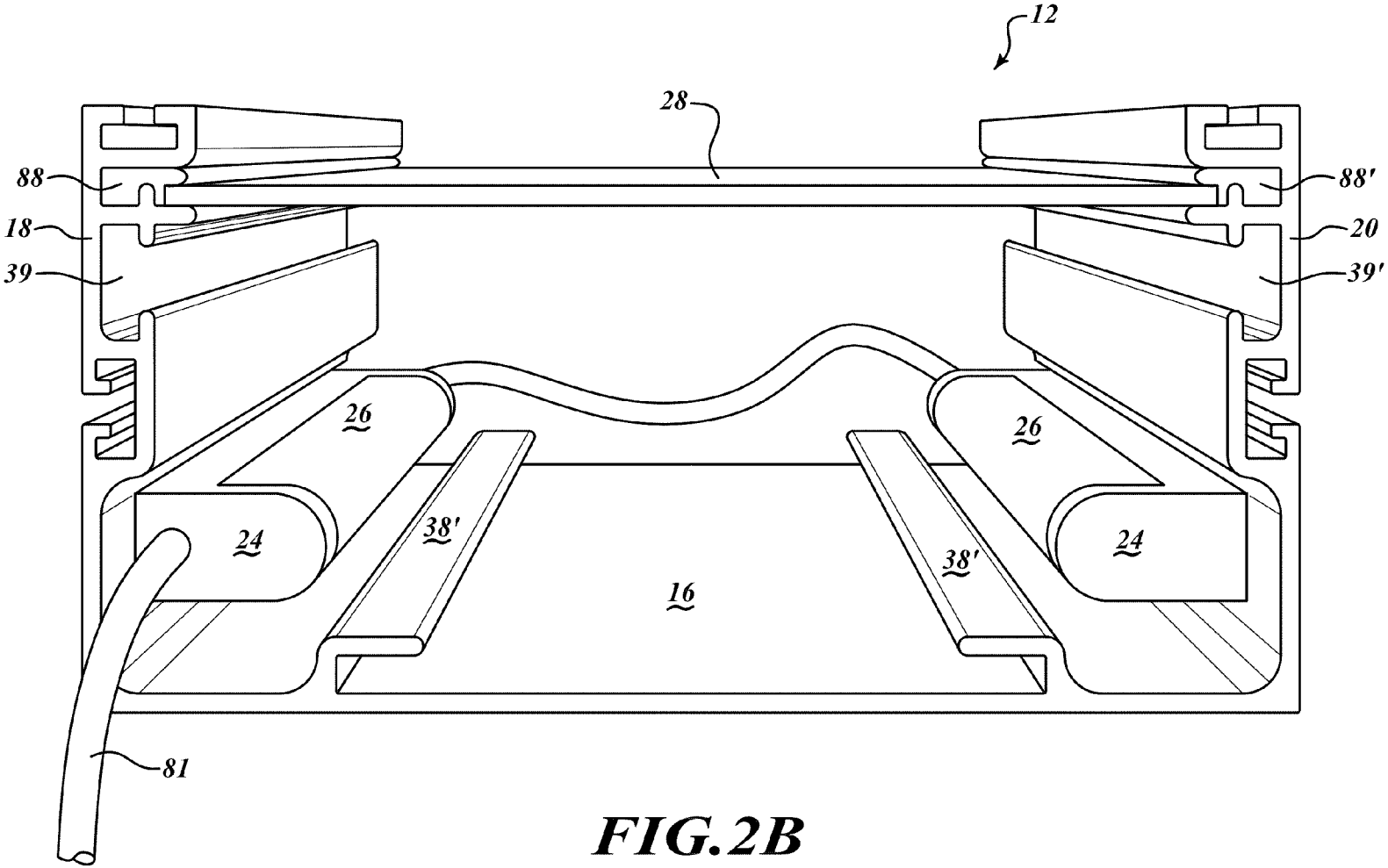
FIG. 2B is a side view diagram of an internally illuminated structural member with dual light fixtures, according to the invention.

FIG. 2B shows an alternate embodiment of an internally illuminated structural member 12 with dual opposed light fixtures 24 mounted to the side walls, according to the invention. Structural members 12 having dual light fixtures 24 radiate additional light that may be preferred depending on the level of diffused light 31 desired.

Figure 3A:
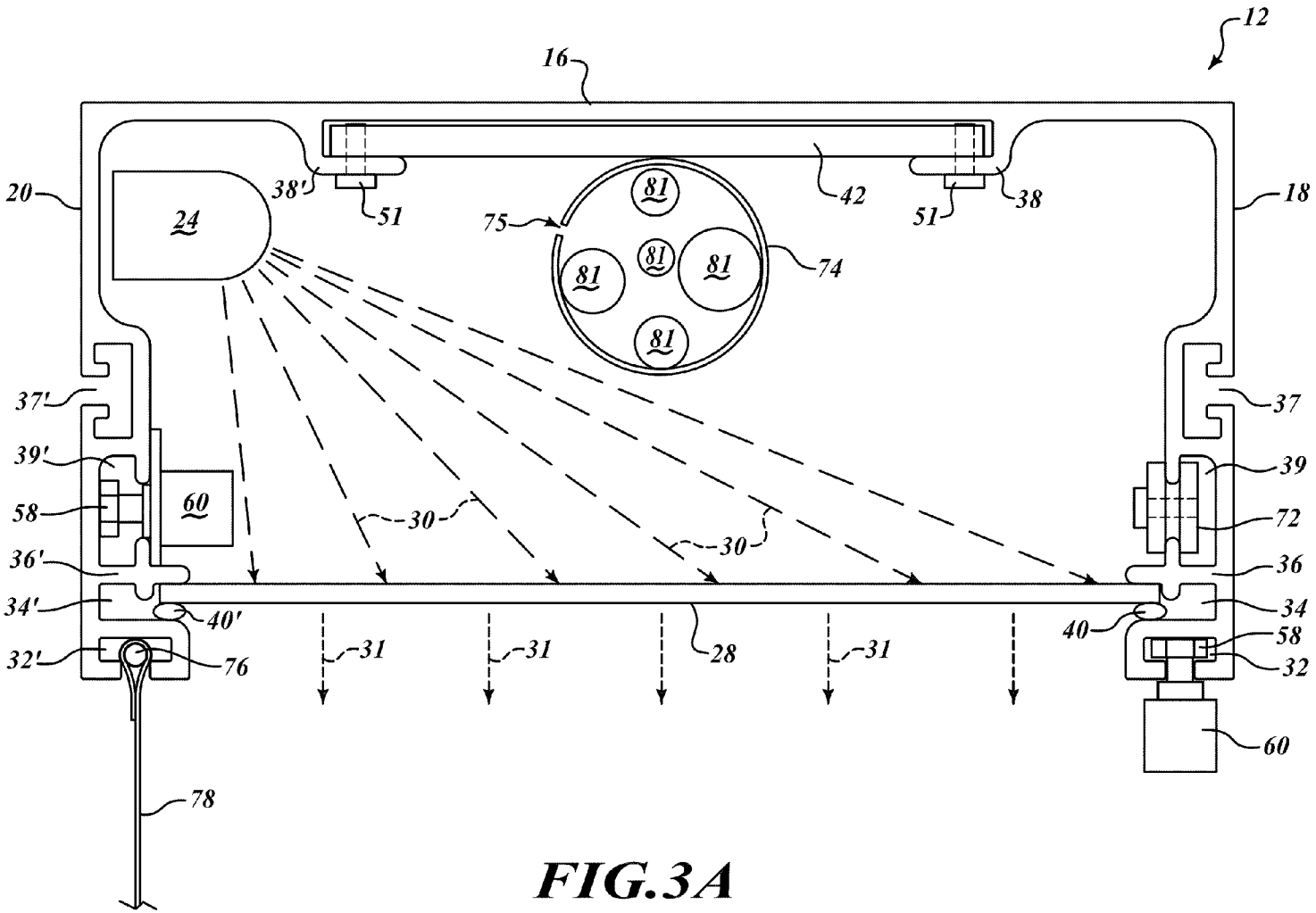
FIG. 3A is a cross-sectional view diagram of an exemplary internally illuminated structural member complete with lighting system and wire management tube.

FIG. 3A shows a cross-sectional view of a structural member 12 complete with lighting system 24, 26 and wire management tube 74. An acrylic cover 28 is shown inserted in the opposed groove openings 34, 34' defined by the inverted T-guides 32, 32' and the cross clips 36, 36', and is retained in position with plastic beading 40, 40' wedged inside the groove openings 34, 34'.

Referring to FIG. 3A, two exemplary connections for the internal T-guides 39, 39' are shown: one is a knob 58; the second is an alignment bar 72. Two exemplary connections for the inverted T-guides 32, 32' also are shown: one is a fabric bead 76 inserted inside the T-guide 32 with fabric sheet 78 extending there from; the second is a knob 58 slidably inserted inside the T-guide 32.

Referring to FIG. 3A, the member 12 further comprises a flexible rubberized wire management tube 74 approximately 2 inches in diameter with a slit opening 75. Wires 81 providing power to the internal light fixture 24, as well as monitors, computers, other lighting, and other electronic devices, are conveniently and neatly tucked inside the tube 74, thereby minimizing interference with the light 30 radiating from the bulb 26 through the cover 28. The cover 28 allows the light 30 to pass through as diffused light 31. The diffused light 31 creates the image of a soft glow.

The tube 74 is retained in position by attachment to a connector plate 42 spanning a channel formed by the L-shaped brackets 38, 38' on the base wall 16. The tube 74 may be attached to the plate 42 by means of hook and loop tape or other fasteners. The connector plate 42 (further shown in FIGS. 6 and 7) is, in turn, retained against the base wall 16 via screws 51 and the opposed L-brackets 38, 38'. The attachment of the tube 74 to the connector plate 42 prevents the tube 74 from resting against the internal face of the cover 28 regardless of the member's 12 orientation and otherwise prevents the tube 74 from coming into contact with the bulb 26.

Figure 3B:
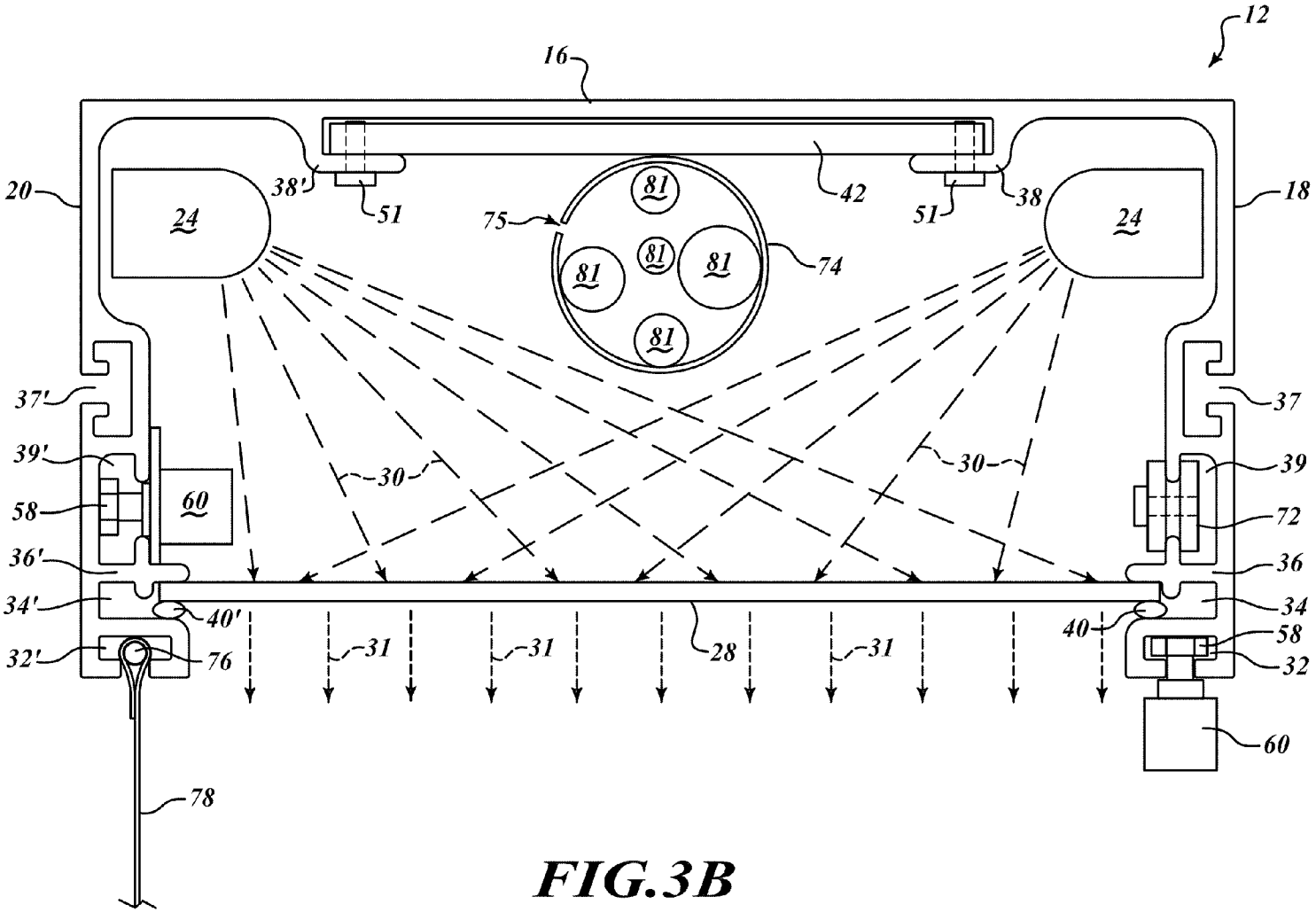
FIG. 3B is a cross-sectional view diagram of an exemplary internally illuminated structural member complete with dual fixture lighting system and wire management tube, according to the invention.

FIG. 3B shows an exemplary structural member having a dual fixture lighting system. The dual fixtures 24 provide balanced and additional light waves 30 which correspond to more diffused light waves 31 crossing the cover 28.

Figure 4A:
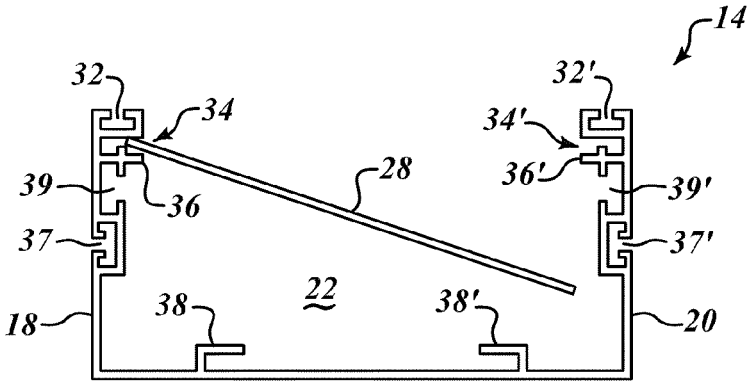
FIGS. 4A-4C are a series of cross-sectional view diagrams of extrusions showing exemplary steps for mounting a cover, according to the invention.
Figure 4B:
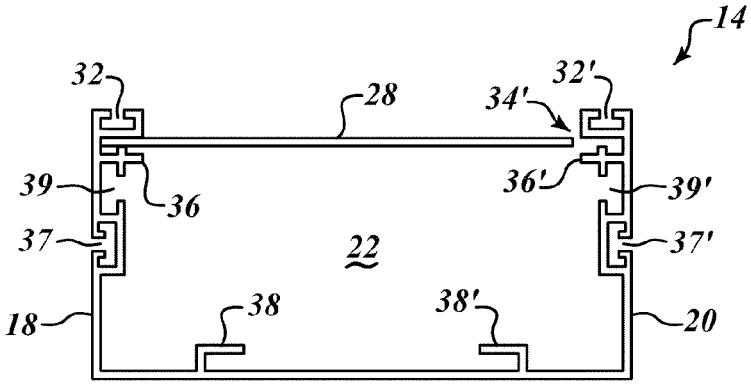
Figure 4C:
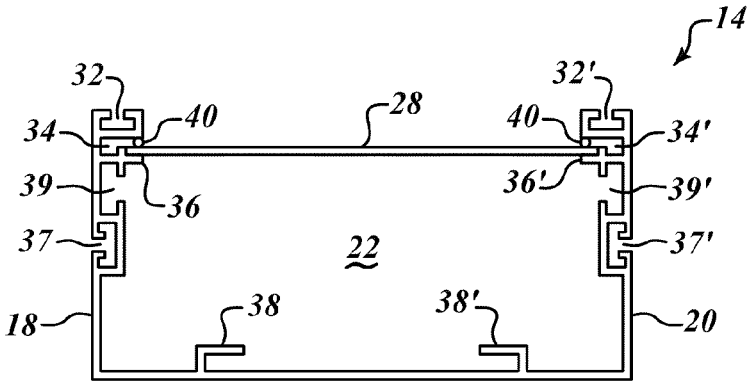

FIGS. 4A-C show a series of cross-sectional views of an extrusion 14 demonstrating how the cover 28 is installed into opposed groove openings 34, 34' defined within the side walls 18, 20. Referring to FIG. 4A, the left margin of the cover 28 is shown inserted into the left groove opening 34 at an angle with the right margin of the cover 28 lower than the left margin. FIG. 4B shows the cover 28 in a position parallel to the base wall 16 ready for insertion of the right margin into the right groove opening 34'. FIG. 4C shows both longitudinal margins of the cover 28 inserted into the opposed groove openings 34, 34' and centered between the left and side walls 18, 20 so that the margins of the cover 28 are resting on the margins of the cross clips 36, 36'. Rubber tubing 40, 40' is shown inserted into the grooves 34, 34' between the cover 28 and the base of the inverted T-guides 32, 32'. The tubing 40, 40' retains the cover 28 in a central position. While rubber tubing 40, 40' is shown in FIG. 4C, any suitable material, such as plastic or vinyl beading, may be utilized to retain the cover 28 in its position within the groove openings 34, 34'.

Figure 4D:
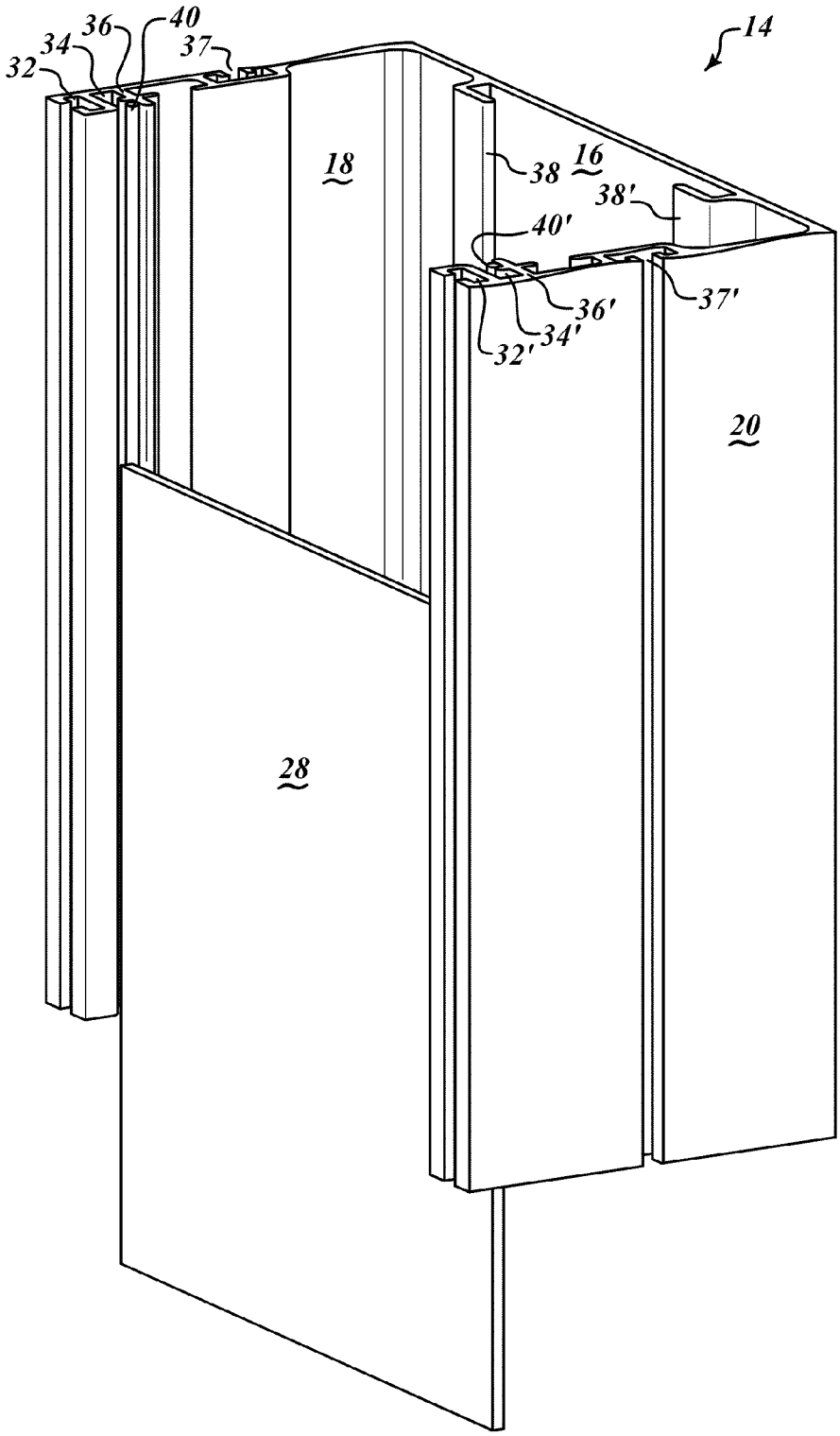
FIG. 4D is a perspective view diagram of an extrusion with cover partially slidably inserted into opposed groove openings, according to the invention.

FIG. 4D shows a perspective view of an extrusion 14 with cover 28 partially slidably inserted into opposed groove openings 34, 34'. The rubber tubing 40, 40' runs the length of the extrusion 14 and retains the cover 28 in position while also allowing the cover 28 to be slidably adjusted along the longitudinal axis of the extrusion 14. The tubing 40, 40' may be glued in position on the member 12 or may be held in position by friction forces generated by pressure applied by the cross clips 36, 36', on the one hand, and the cover 28, on the other hand.

Because the cover 28 is slidably adjustable within the extrusion 14, persons installing a structure 2, such as the exemplary structure shown in FIG. 1A, may initially construct the structure 2 without covers 28, thereby allowing easy access to the interior spaces 22 for access to the lighting fixtures 24 and wire management tubes 74. Once the lighting fixtures 24 are linked, and the bulbs 26 have been tested and are working as desired, the covers 28 may be inserted as described in connection with FIGS. 4A-C and then slidably adjusted into the desired position as described in connection with FIG. 4D. Once power is provided, the result is an enclosed member 12 with a face that glows with dissipated light 31 passing through the cover 28 (shown in FIGS. 3A and 3B).

Figure 4E:
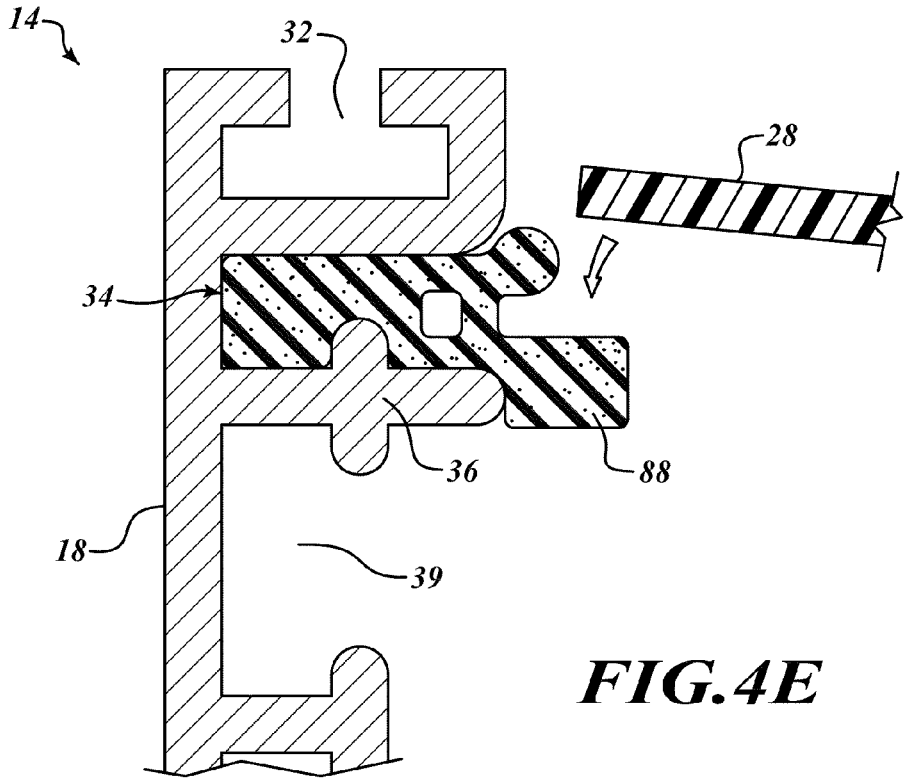
FIGS. 4E and 4F are cross-sectional view diagrams of a cover being installed into a retaining strip inserted into a groove opening, according to the invention.
Figure 4F:
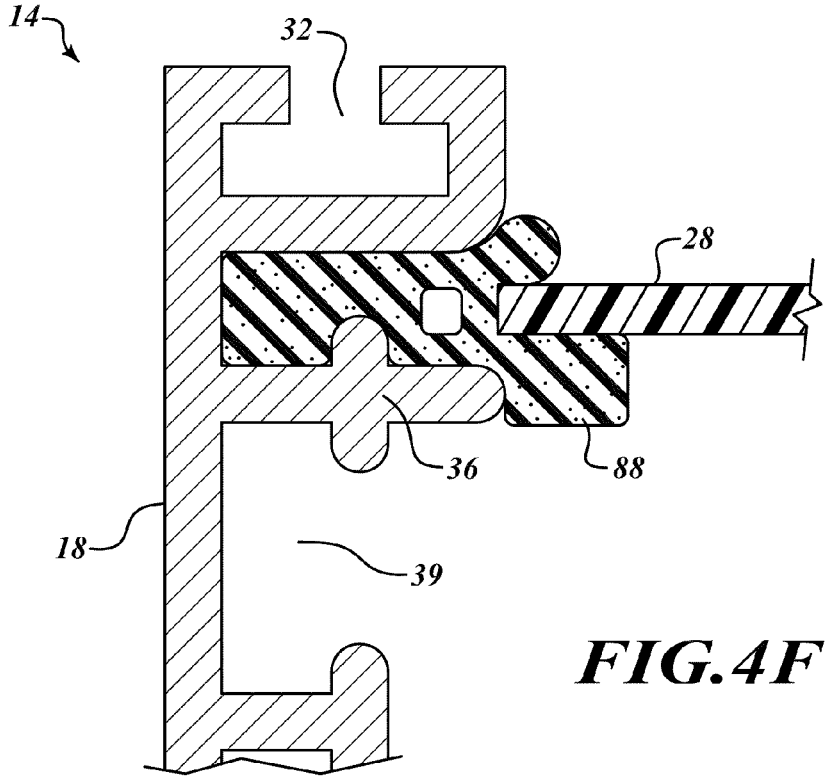

FIGS. 4E and 4F illustrate an alternate method for retaining the cover 28 in position, namely, through insertion of the cover 28 edges into opposed retaining strips 88. FIGS. 4E and 4F show an edge of a cover 28 being installed into a retaining strip 88. The retaining strip 88 may be used in lieu of the beading 40 shown in FIGS. 3A and 3B. In the preferred embodiment, the strip 88 is made of a flexible, rubberized material custom shaped to fill the space formed by the groove opening 34. The strip 88 is further shaped to form a generally rectangular slot opening extending laterally into the interior space for insertion and retention of the cover's 28 edge. The slot dimensions are smaller than the width of the cover 28 so that the edge of the cover is snapped into the slot with manual pressure for added retention strength.

FIGS. 5A-H show a series of cross-sectional views of extrusions 14 with a plurality of exemplary connections to custom features. The inverted T-guides 32, 32', the internal T-guides 39, 39', and the external T-guides 37, 37' allow for multiple variations of connections between the members 12 and a nonexclusive variety of banners, fabric sheets, large scale graphics, face mounts, shelf assemblies, panels, storage towers, fascia attachments, steel bars, rigid laminated birch panels, and the like.

Figure 5A:
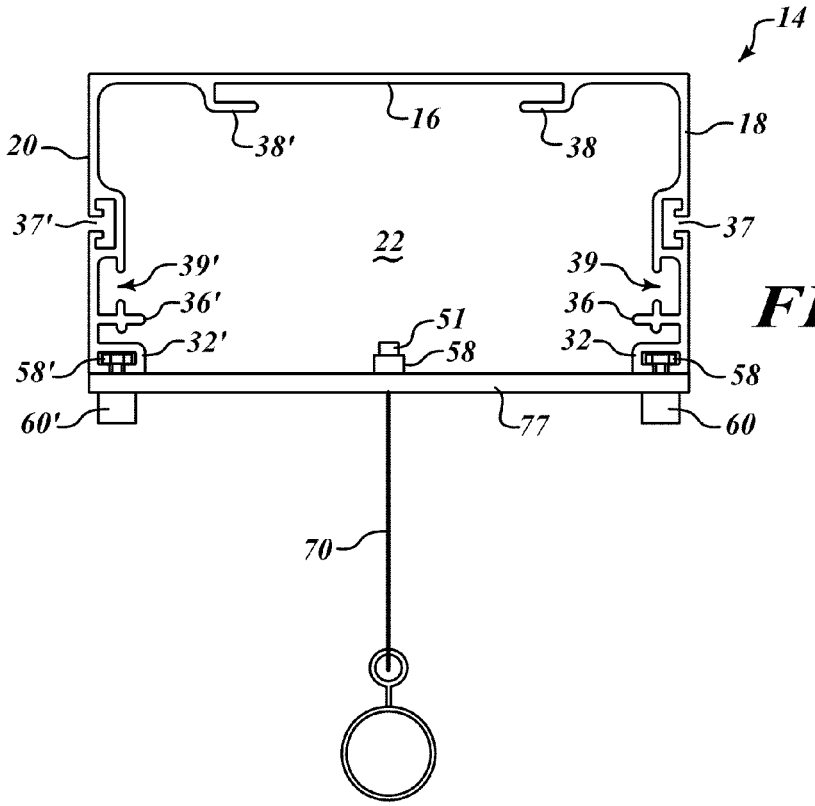
FIGS. 5A-5H are a series of cross-sectional view diagrams of extrusions with different exemplary connection options to banners, fabric sheets, large scale graphics, shelves, face mounts, side mounts and storage towers, according to the invention.

FIG. 5A is a side view of an exemplary attachment for a single banner 70. A panel 77 is attached to the upper margins of side walls 18, 20. Knobs 58, 58' are slidably inserted inside respective inverted T-guides 32, 32'. The ends of the knobs 58, 58' are inserted through holes in the panel 77 (not shown) with screw caps 60, 60' screwed onto the knob ends 58, 58' to retain the panel 77 against the upper margins of the left and right side walls 18, 20. The banner 70 is attached to the panel 77 via knob 58 and screw 51 extending through a hole (not shown) formed in the cover 28. The banner 70 may hang freely if its top margin is mounted to a horizontally-oriented member and it is weighted at the base. Alternately, the opposed end of the banner 70 (not shown) may be connected to another member 12 through similar means of attachment.

FIG. 5A also illustrates an alternate method for mounting the cover 28. As shown in FIG. 5A, the cover 28 may be retained flush against the upper margins of the side walls. In this embodiment, the margins of the cover 28 are retained against the inverted T-guides 32, 32' across the outer perimeter of the member 12 via opposed knobs 58, 58' and screw caps 60, 60' inserted through holes (not shown) formed in the cover 28.

Figure 5B:
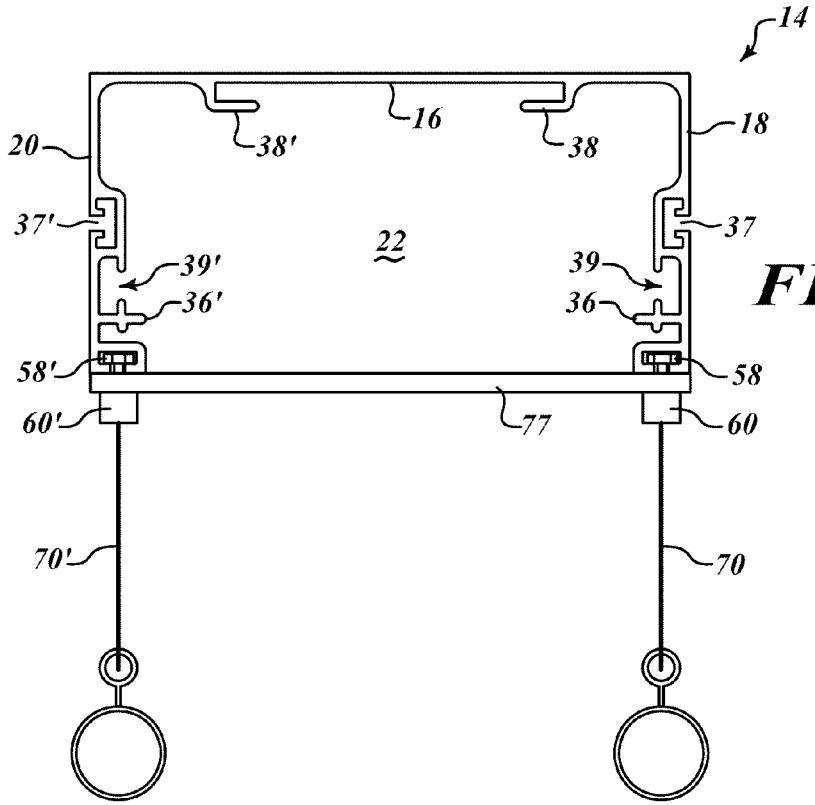

FIG. 5B is a side view of an exemplary attachment for a double banner 70, 70'. A panel 77 is attached to the margins of the extrusion 14 left 18 and right 20 side walls. Knobs 58, 58' are slidably inserted inside respective inverted T-guides 32, 32'. The ends of the knobs 58, 58' are inserted through holes in the panel 77 (not shown) with screw caps 60, 60' screwed onto the knob ends 58, 58' to retain the panel 77 against the upper margins of the left and right side walls 18, 20. The banners 70, 70' are attached to the spaced screw caps 60, 60' and extend perpendicularly from the panel 77. The banners 70, 70' may hang freely if weighted at the base; alternately, the opposed ends of the banners 70, 70' may be connected to one or more other members 12.

The material for the banners shown in FIGS. 5A and 5B may be selected from plastic, nylon, polyester, cotton, or any other desired material or combination thereof. They may be sheer enough to allow light to pass through them or opaque. They may be or a single color or pattern, or have customized information printed or displayed on them. A combination of different banners may be utilized in a structure 2.

Figure 5C:
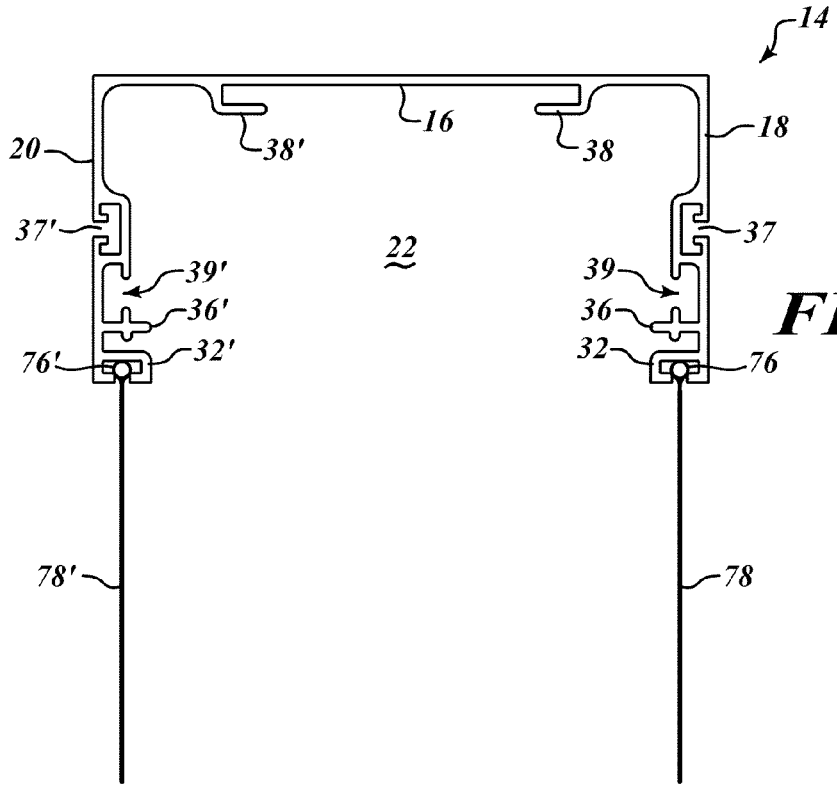

FIG. 5C is a top view diagram of an exemplary attachment for a double banner made of fabric sheets 78, 78' with beaded edges. A rounded bead 76 around which fabric 78 has been stretched is slidably inserted in the left wall 18 inverted T-guide 32. Likewise, a second rounded bead 76' around which a fabric sheet 78' has been stretched is slidably inserted in the right wall 20 inverted T-guide 32'. The fabric sheets 78, 78' extend in parallel with the extrusion 14 walls 18, 20. Alternately, the fabric 78, 78' may be pulled to varying angles in relation to the extrusion 14 walls 18, 20. The fabric sheets 78, 78' may hang freely if weighted at the base; alternately, the opposed ends of the fabric sheets 78, 78' (not shown) may be connected to one or more members 12.

Figure 5D:
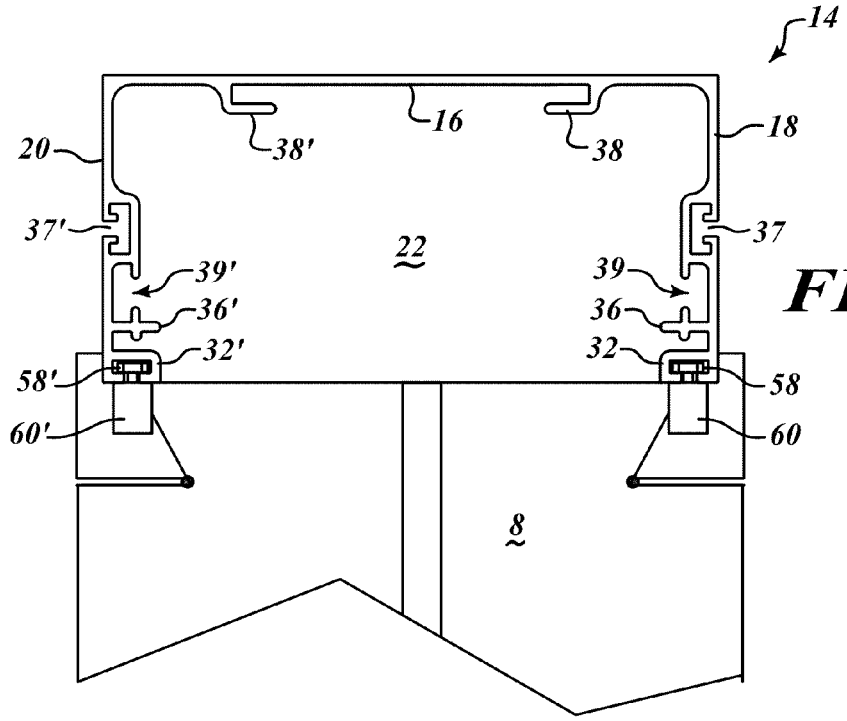

FIG. 5D is a top view diagram of an exemplary shelf 8 attachment. A shelf 8 is attached to the margins of an extrusion 14 having left 18 and right 20 side walls. Knobs 58, 58' are slidably inserted inside respective inverted T-guides 32, 32' in the side walls 18, 20. The ends of the knobs 58, 58' are inserted through holes in the shelf 8 (not shown) with screw caps 60, 60' screwed onto the knob ends 58, 58' to retain the shelf 8 in position. The shelf 8 is attached to the spaced screw caps 60, 60' and extends horizontally from a vertically oriented extrusion 14. The shelf 8 extends to a second extrusion 14 with similar attachment (not shown). A plurality of shelves 8 may be installed as desired. The resulting appearance of the shelving 8 is that it floats on the members 12 with light emanating from the members 12 onto the shelving 8 surface thereby illuminating any objects retained on the shelf 8.

Figure 5E:
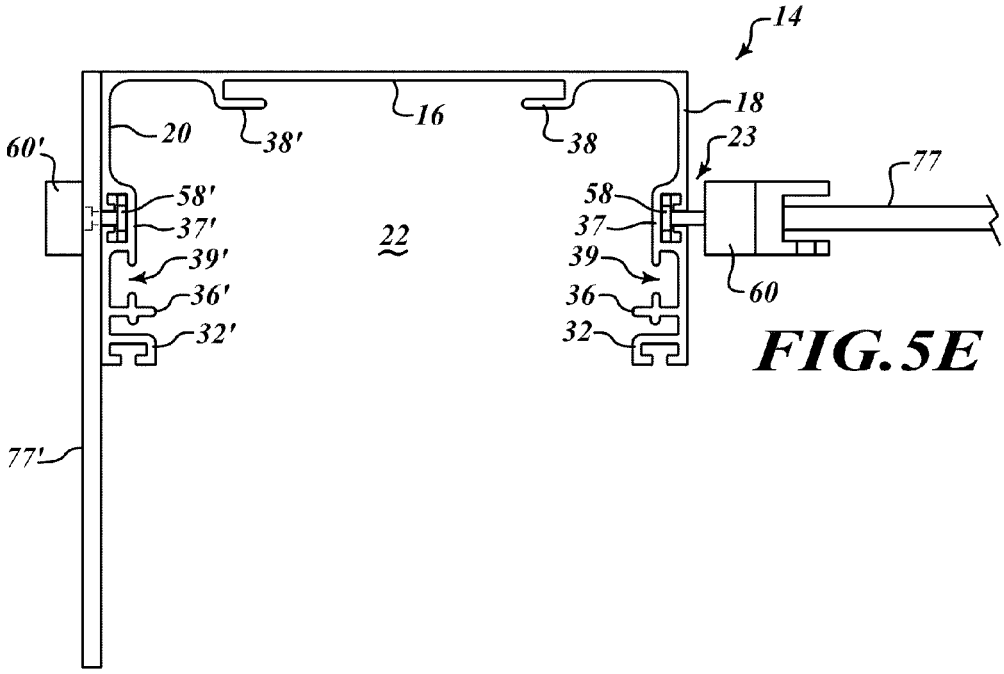

FIG. 5E is a top view diagram of exemplary attachments of an extrusion 14 to panels 77 in both a face mount position and a side mount position. The side mount of a first panel 77 is perpendicular to the left wall 18 of the extrusion 14. The panel 77 is mounted to a screw cap 60. A knob 58 is shown slidably inserted inside the external T-guide 37, with the screw cap 60 inserted thereon. The screw cap 60 is offset from the knob 58 creating a space 23 defined by the screw cap 60 and left side wall 18 of the extrusion 14. The result is a panel 77 that appears to the viewer to float between the extrusion 14 and the opposed end margin of the panel 77 (not shown). The opposed end margin of the panel 77 (not shown) may be freely extending into space or may be attached to another extrusion 14.

Referring again to FIG. 5E, the face mount of a second panel 77' is shown flush against the right side wall 20 of the extrusion 14. The panel 77' extends away from the extrusion 14 in parallel with the right side wall 20. The face mount panel 77' is removably secured to the extrusion 14 via a knob 58' with head slidably inserted inside the external T-guide 37', a screw portion extending through a hole in the panel (shown in cross-section), and a screw cap 60 tightened over the screw portion of the knob 58'. The result is a panel 77' that may be retained in any position along the axis of the extrusion 14. The opposed end margin of the panel 77' (not shown) may be freely extending into space or may be attached to another extrusion 14.

Figure 5F:
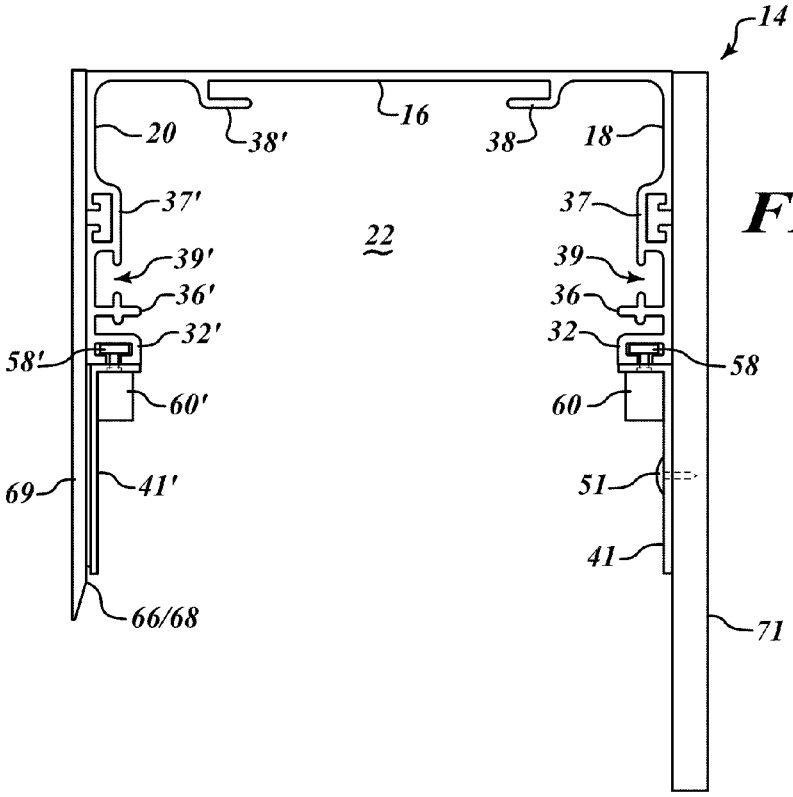

FIG. 5F is a top view diagram showing alternate methods of attachment that do not reveal any protruding parts to the viewer and are referred to as "skin" attachments. Referring to the left side wall 18, a knob 58 is shown slidably inserted inside the inverted T-guide 32 with screw extending through a hole in an L-bracket 41. The L-bracket 41 is secured in position by a tightened screw cap 60. The skin attachment 71 is a 0.5 inch rigid laminated birch panel, but may be of any suitable or desirable material and thickness. The skin attachment 71 is retained by a screw 51 inserted through a hole in the L-bracket into the skin attachment 71.

Referring to the right side wall 20 of FIG. 5F, a second type of skin attachment is shown, namely, a steel bar 69 retained against an L-bracket 41' by hook and loop fasteners 66/68. The L-bracket 41' is, in turn, retained in position via a screw cap 60' inserted over a knob 58' slidably inserted inside the inverted T-guide 32'.

Figure 5G:
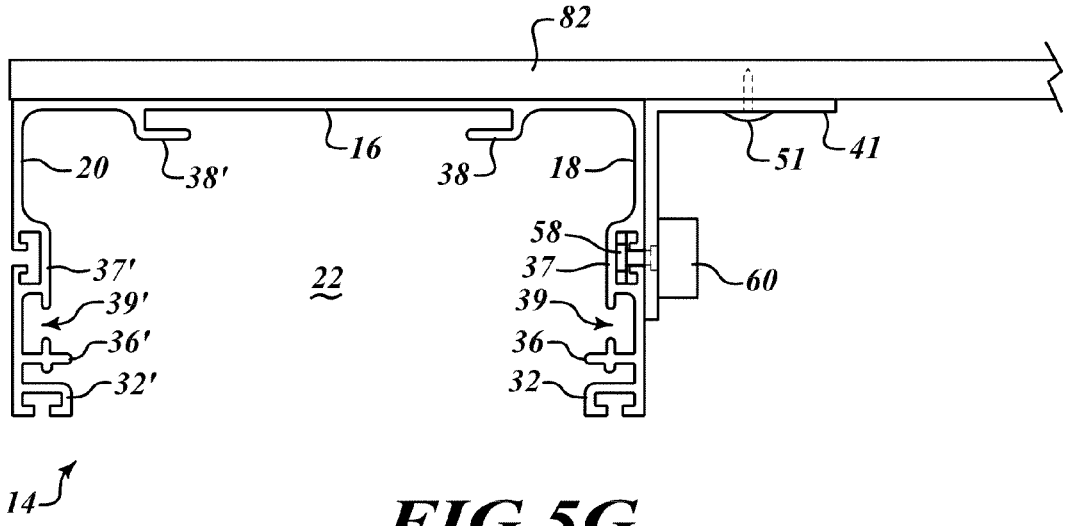
Figure 5H:
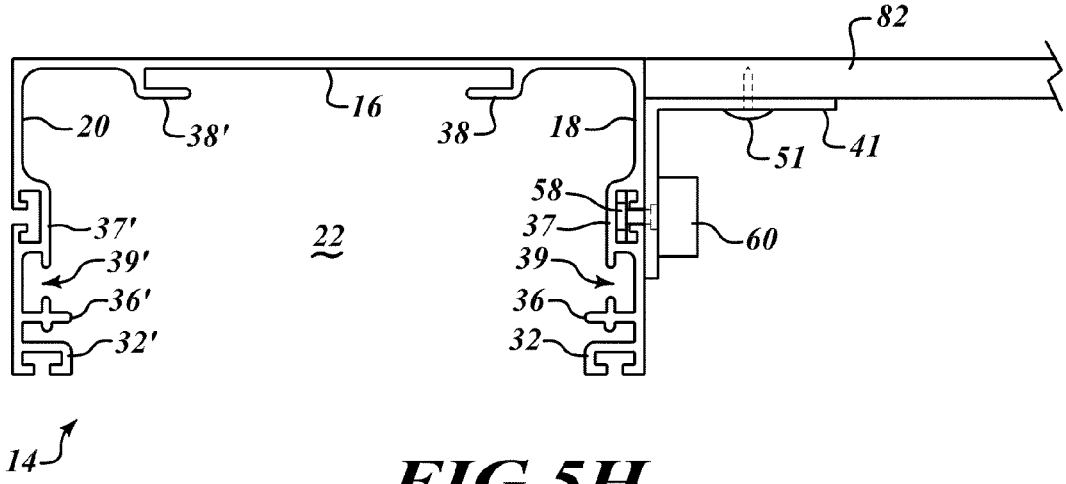

FIGS. 5G and 5H are top view diagrams showing exemplary connections between an extrusion 14 and a non-extrusion type structure, such as a storage tower 82. The tower 82 attachment shown in FIG. 5G is a flush connection to a storage tower 82 panel extending along the base wall 16 of the extrusion 14. The tower 82 is attached via one or more screws 51 to a corner L-bracket 41 positioned with one arm of the bracket 41 flush with the left side wall 18, and the other arm extending flush with the base wall 16. A knob 58 and screw cap 60 retain the L-bracket 41 in any desired position along the longitudinal axis of the extrusion 14.

FIG. 5H shows an alternate corner connection to a storage tower 82 with the tower attachment perpendicular to the left side wall 18 of the extrusion 14. The tower 82 is positioned flush with the base wall 16 of the extrusion 14, with an L-bracket 41 retaining the tower 82 in position via screw 51 inserted through the L-bracket 41 into the tower 82. The L-bracket 41 is, in turn, removably attached to the left side wall 18 by knob 58 inserted into the external T-guide 37 with screw extending through the L-bracket 41 into a tightened screw cap 60.

Method of Construction

Figure 6:
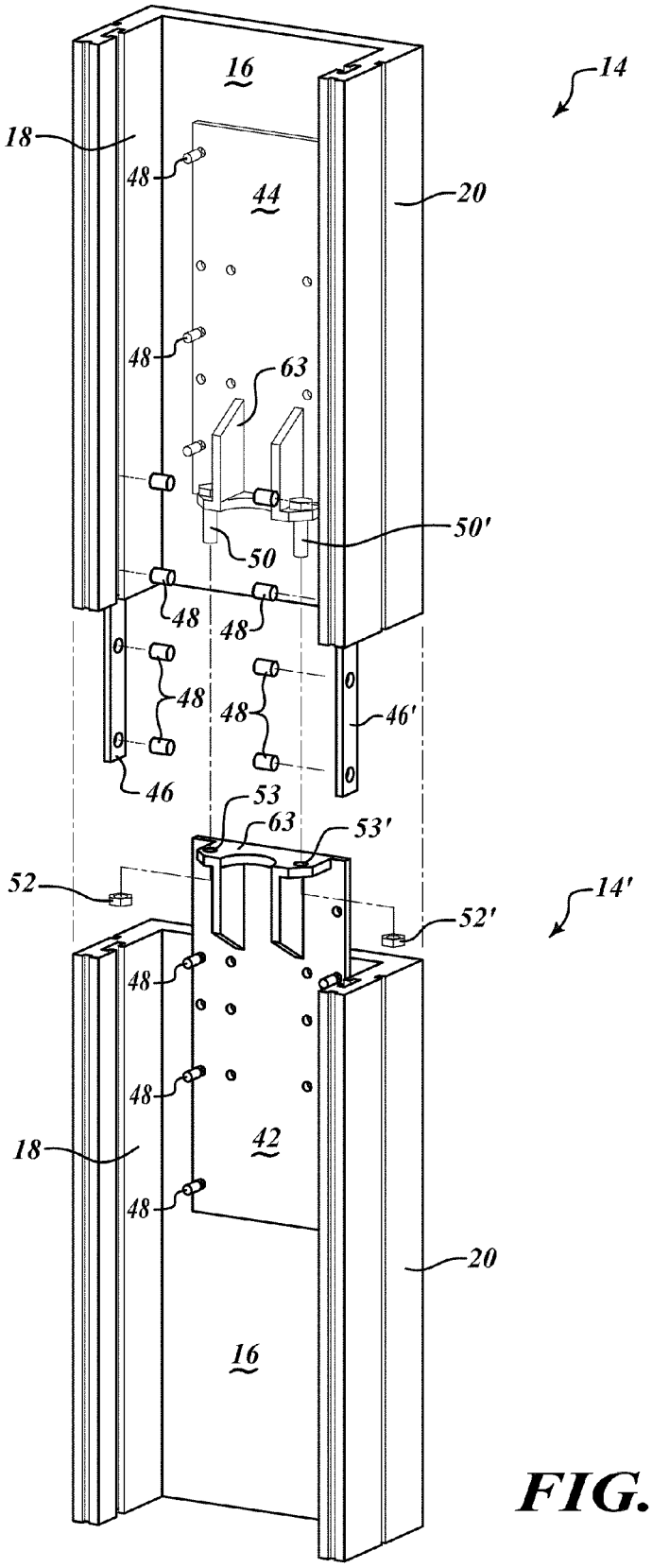
FIG. 6 is an exploded perspective view diagram of an upper extrusion positioned above a lower extrusion for connection, according to the invention.

One of the primary advantages to the Internally Illuminated Extrusion Architecture of this application is its ease of construction and tear down. FIG. 6 shows an exploded perspective view of an exemplary connection between two vertically-oriented extrusions 14, 14' according to the invention. For simplicity, certain features are not shown in FIG. 6, including without limitation, cross clips 36, internal T-guides 39, lighting fixtures 24, bulbs 26, and wire management tubes 74.

Referring to FIG. 6, a first (upper) extrusion 14 comprises a recessed connector plate 44 securely attached to the base wall 16 of the first extrusion 14 via socket cap screws 48 and offset from the bottom margin of the extrusion 14. The recessed connector plate 44 includes a bracket 63 with dual, spaced bolts 50, 50' mounted along the longitudinal axis of the extrusion 14. The first extrusion 14 further comprises dual, opposed connector rails 46, 46' slidably inserted within the internal T-guides 39, 39' (shown in FIGS. 2 and 3).

Referring to FIG. 6, a second (lower) extrusion 14' comprises a protruding connector plate 42 extending from the extrusion's 14' upper margin. The connector plate 42 comprises a bracket 63 at its upper margin with spaced holes 53, 53' formed in the upper margin of the bracket 63. The center portion of the bracket 63 is curved concavely to accommodate the wire management tube 74 (shown in FIG. 3A). The connector plate 42 is securely attached to the base wall 16 of the second extrusion 14' via socket cap screws 48.

Referring to FIG. 6, a method of connecting the first and second extrusions 14, 14' comprises the steps of: 1) positioning the first extrusion 14 having the recessed connector plate 44 relative to the second extrusion 14' having the protruding connector plate 42 so as to align the recessed connector plate 44 with the protruding connector plate 42; 2) inserting opposed spaced connector rails 46, 46' into the internal T-guides 39, 39' (shown in FIGS. 2A and 3A) of the first extrusion 44; 3) lowering the first extrusion 14 onto the second extrusion 14' to slidably engage the rails 46, 46' into the T-guides 39, 39' of the second extrusion 14'; 4) inserting bolts 50, 50' on the recessed plate 44 through the holes 53, 53' on the protruding plate 42; 5) tightening the rails 46, 46' with a plurality of socket cap screws 48; and, 6) tightening the bolts 50, 50' with the nuts 52, 52'. The result is a secure but removable connection between the extrusions 14, 14' consisting of a connection between respective side walls 18, 20 (the two internal rails 46, 46'), a connection at the base walls 16 (bolts 50, 50'), and the additional structural stability provided by plate 42 overlapping against the base wall 16 of the first extrusion 14.

Figure 7:
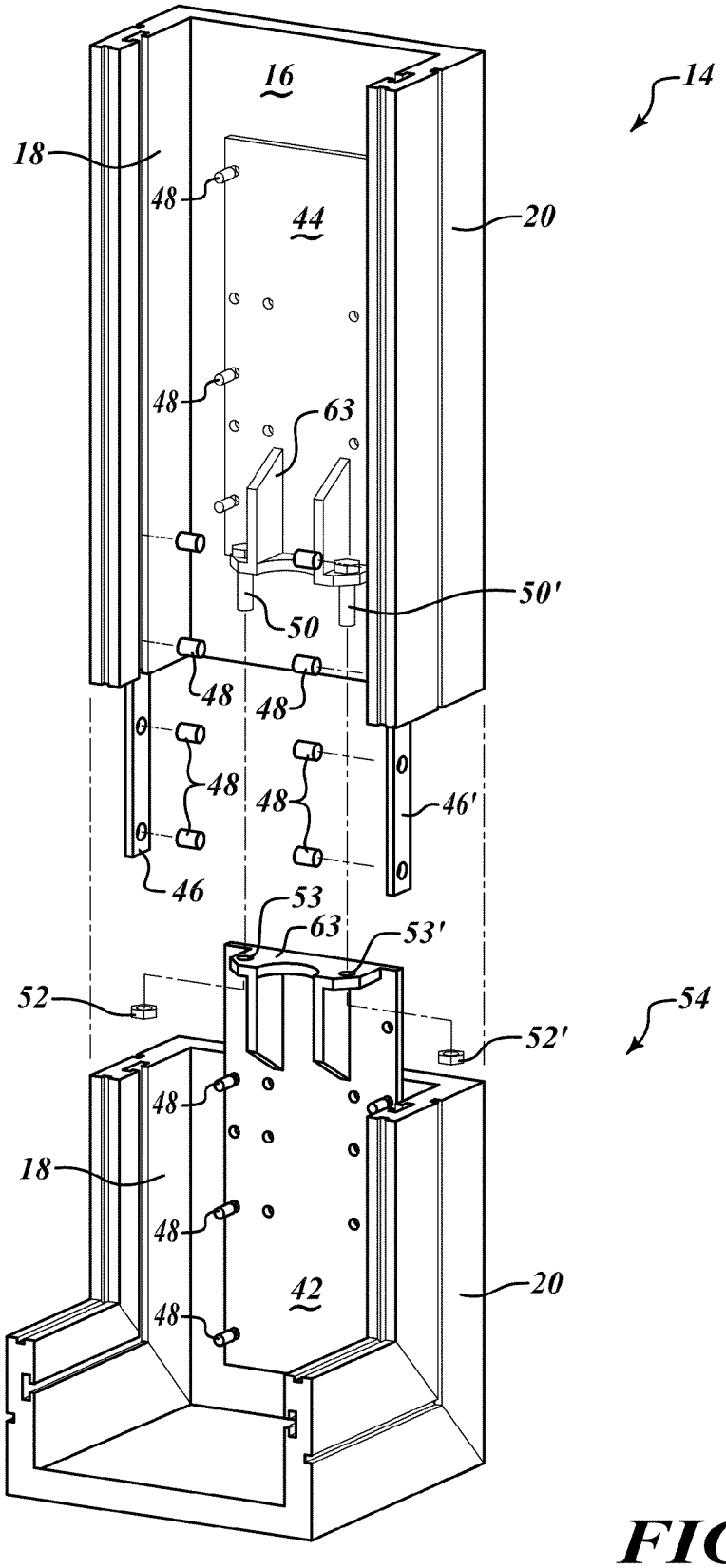
FIG. 7 is an exploded perspective view diagram of a vertically-oriented extrusion positioned above a corner extrusion for connection, according to the invention.

FIG. 7 shows an exploded perspective view of a vertically-oriented extrusion 14 positioned above a corner extrusion 54 for connection, according to the invention. As shown in FIG. 7, the connection of an extrusion 14 to a corner extrusion 54 does not differ from the connection shown in FIG. 6, making the system easy to set up and dismantle. The method comprises the steps of: 1) inserting opposed connector rails 46, 46' into the internal T-guides 39, 39' (shown in FIGS. 2A and 3A) of the extrusion 14; 2) positioning the extrusion 14 and corner extrusion 54 so as to align the connector plates 42, 44; 3) lowering the extrusion 14 onto the corner extrusion 54 to slidably engage the rails 46, 46' into the T-guides 39, 39' of the corner extrusion 54; inserting bolts 50, 50' through the holes 53, 53'; 4) tightening the rails 46, 46' with socket cap screws 48; and, 5) tightening bolts 50, 50' with nuts 52, 52'. The result is a secure but removable connection between the extrusions 14, 54 consisting of a connection between respective side walls 18, 20 (the two internal rails 46, 46'), a connection at the base walls 16 (bolts 50, 50'), and the additional structural stability provided by plate 42 overlapping against the base wall 16 of the extrusion 14.

Figure 8:
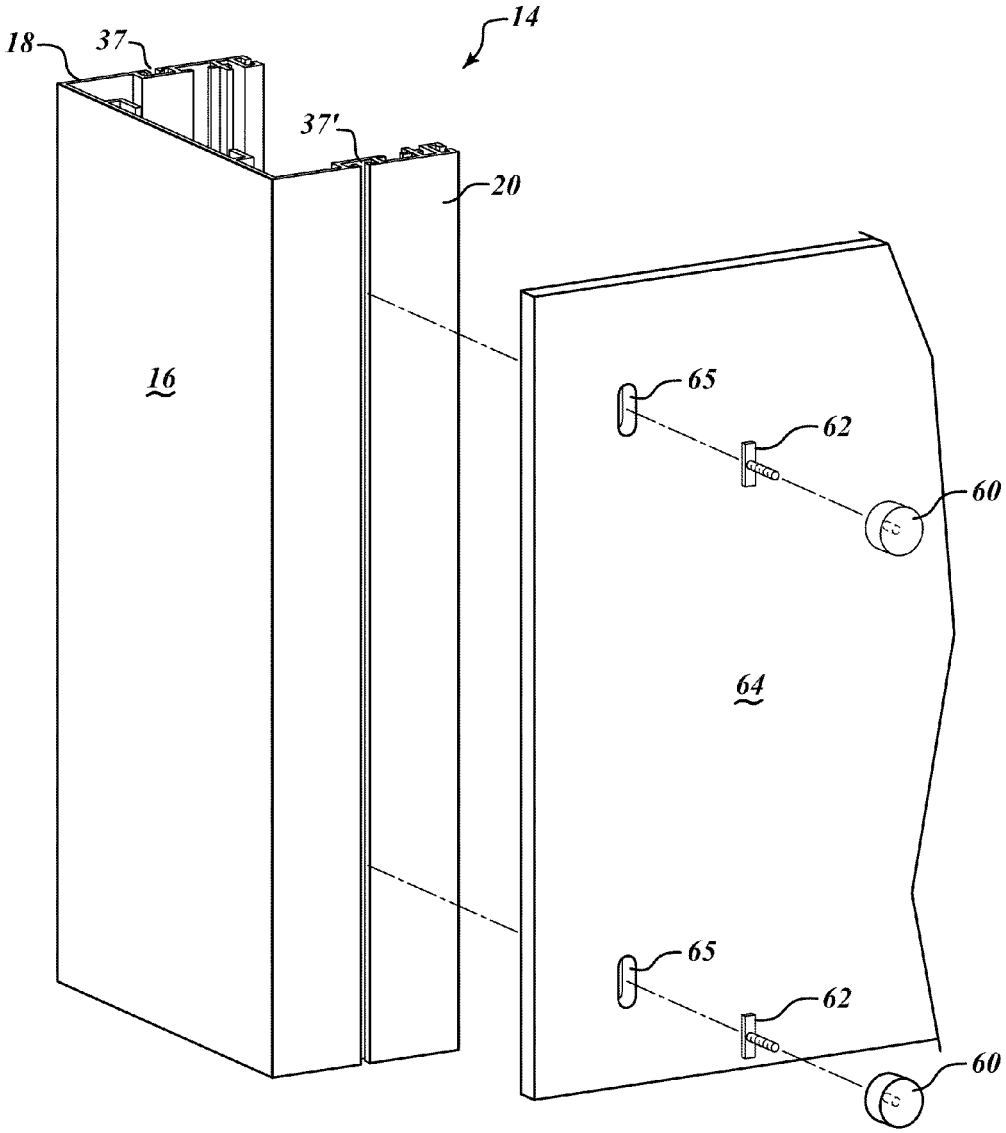
FIG. 8 is an exploded perspective view diagram of the connection between an extrusion and a monitor mounting panel, according to the invention; and, FIG. 9 is a perspective view drawing of an alternate exemplary internally illuminated structure, according to the invention.

FIG. 8 shows an exploded perspective view of an exemplary external connection between an extrusion 14 and a monitor mounting panel 64. As shown in FIG. 8, a method for connecting a flat surfaced-object to an external face of an extrusion 14 comprises the steps of: 1) inserting a T-shaped screw pin 62 into the external T guide 37'; 2) sliding the pin 62 to the desired position along the extrusion 14; 3) turning the pin 62 approximately 20 degrees to rotate the top of the "T" portion of the pin 62 within the T guide 37' to secure it in position; 4) positioning the plasma monitor stand 64 against the external face of the right wall 20 of the extrusion 14; 5) lining up the hole 65 defined in the stand 64 with the pin 62 so that the pin 62 extends through the stand 64; and, 6) tightening a screw cap 60 onto the screw pin 62.

Referring to FIGS. 1-8, an overall method of constructing the internally illuminated extrusion architecture 2 comprises the steps of: 1) connecting a plurality of members 12 to form a desired structure 2; 2) mounting the covers 28; and, 3) providing electric power to the lighting fixtures 24. The method may further include the steps of: 1) attaching at least one post member 4 to a base plate for additional structural stability and proximity to a power source on the base plate; 2) connecting the electric cords 81 between the light fixtures 24; 3) tucking the cords 81 inside the wire management tube 74; and, 4) attaching custom features as desired, including without limitation, banners, fabric sheets, large scale graphics, shelf assemblies, panels, fascia attachments, skin attachments, headers, canopies, bars, storage towers, tables, and/or workstations, at any desired point along the longitudinal axis of the members.

Structural Strength

Figure 9:
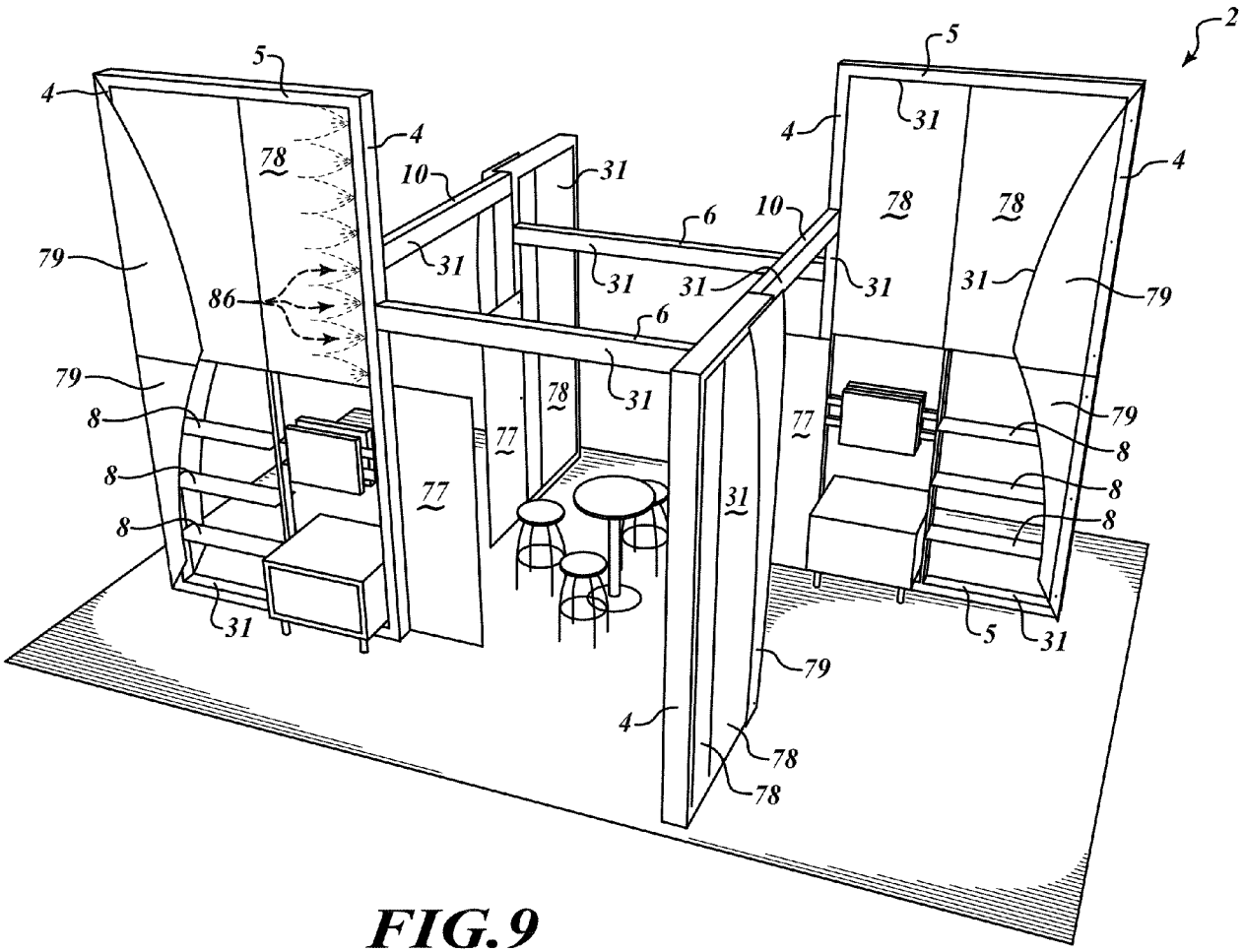

FIG. 9 demonstrates an alternate exemplary structure 2 illustrating both the versatility and the structural load-bearing aspects of the present invention. As shown in FIG. 9, the members 4 (posts), 5 (corner members), 6 (ceiling spans), and 10 (beams) both define and make up the structural components of the architecture 2. The vertical posts 4 of varying heights define the structure's 2 upper limits and provide vertical structural support. The horizontal ceiling spans 6, corner members 5 and beams 10 define the footprint for the structure 2 and provide lateral support and stability. All members 4, 5, 6, 10 emanate diffused light 31 along their lengths to provide a continuous glowing appearance to the entire structure 2.

As shown in FIG. 9, the structure 2 may include fabric sheets 78, fabric 78 with halogen spot lighting 86, fascia 79, and panels 77. Alternate embodiments further include perforated or diffuse fascia 79. As shown in FIG. 9, shelving units 8 extend between posts 4. As discussed in connection with FIG. 5D, the shelving 8 is retained by knobs 58 slidably inserted inside the respective inverted T-guides 32, 32' within the post 4 extrusions 14. The result is shelving 8 that appears to float between the posts 4. Diffused light 31 emanates from within the posts 4 and radiates onto any objects retained upon the shelving 8, thereby drawing attention to items placed thereon.

Despite the varied elements of the structure 2, visually, the structure 2 is integrated as one due to the glowing effect 31 uniformly radiated from the lengths of each structural member 4, 5, 6, 10. The illuminated architecture is pleasing to view and is inviting.

INDUSTRIAL APPLICABILITY

It is clear that the inventive Internally Illuminated Extrusion Architecture of this application has wide applicability to the trade show, exhibition, retail, and corporate display industries, namely to provide extremely versatile structures that have the added benefit of providing welcoming attention due to their visual continuity of a glowing effect. The members can be used to construct both large and small-scale structures, including structures of varying foot-prints; the versatility of lengths and connections between members allow a user to be creative and to be set apart from the competition, and the assemblies are easy to install, dismantle, reconfigure, transport, and maintain. The architecture of this application allows for large structures to be constructed using fewer components, thereby saving time and costs in set up and tear down.

It should be understood that various modifications within the scope of this invention can be made by one of ordinary skill in the art without departing from the spirit thereof and without undue experimentation. For example, the cover 28 may be constructed of any suitable material, including polystyrenes, fabrics, composites and/or other materials, and may include openings, materials of differing thicknesses (to alter the diffusion characteristics), and/or may include varying materials having different diffusion properties; the extrusion 14 may be constructed of any suitable metal, alloy, plastic, composite, or other material; the light fixtures 24 may be mounted at any suitable or desired position(s) within the extrusions 14; any suitable or desirable configuration, shape, number and positioning of guides 32, 37, 39, clips 36, brackets 38, and groove openings 34 may be utilized; and, any suitable or desired number of light fixtures 24 and bulbs 26 (including different colored bulbs and/or different types of bulbs, e.g., fluorescent, LED, spot lights) may be utilized to create the internally glowing effect 31. This invention is therefore to be defined as broadly as the prior art will permit, and in view of the specification if need be, including a full range of current and future equivalents thereof.

I claim:

1. An internally illuminated structural member comprising:

a linear extrusion having a defined length and generally rectangular-shaped spaced left and right side walls, each of said side walls having a bottom edge, and an upper margin;

said side walls joined along their bottom edges by a center base wall to form a generally rectangular U-shaped opening defining an interior space;

opposed inverted T-guides integral to the upper margins of the side walls, said T-guides extending laterally into the interior space;

opposed cross clips integral to the side walls extending laterally into the interior space;

opposed groove openings integral to the side walls extending laterally into the interior space, said openings defined by the inverted T-guides and cross clips;

opposed internal T-guides integral to the side walls extending laterally into the interior space;

opposed external T-guides integral to the side walls;

opposed spaced L-brackets integral to the base wall extending laterally into the interior space;

at least one lighting fixture mounted within the interior space, a bulb mounted within the fixture;

a generally planar cover spanning the U-shaped opening proximate the upper margins of the side walls, opposed edges of said cover retained within the groove openings, said cover having a diffusion coefficient sufficient to allow light generated by the lighting fixture and bulb when powered to pass through said cover; and, wherein each of said T-guides, clips, groove openings, L-brackets and cover runs the length of the extrusion.

2. The member of claim 1, wherein the extrusion is made of a material selected from aluminum alloy, metal, metal alloy, plastic, plastic composite.

3. The member of claim 1, wherein the cover is made of a material selected from acrylic plastic, polystyrene, plastic composite, fabric, perforated material.

4. The member of claim 1, wherein the cover is made of one or more materials having different coefficients of diffusion.

5. The member of claim 1, further comprising a wire management tube.

6. The member of claim 1, further comprising a connector plate.

7. The member of claim 1, further comprising a retaining strip.

8. The member of claim 1, wherein the cover is retained flush against the upper margins of the side walls.

9. The member of claim 1, wherein the lighting fixtures comprise two opposed fixtures mounted to respective side walls, each fixture capable of providing power to at least one bulb.

10. The member of claim 1, wherein the member is capable of supporting a live load comprising a plurality of other internally illuminated structural members.

11. An internally illuminated architectural structure comprising:

A plurality of connected internally illuminated extrusion-based structural members, said members comprising:

a linear extrusion having a defined length and generally rectangular-shaped spaced left and right side walls, each of said side walls having a bottom edge, and an upper margin;

said side walls joined along their bottom edges by a center base wall to form a generally rectangular U-shaped opening defining an interior space;

opposed inverted T-guides integral to the upper margins of the side walls, said T-guides extending laterally into the interior space;

opposed cross clips integral to the side walls extending laterally into the interior space;

opposed groove openings integral to the side walls extending laterally into the interior space, said openings defined by the inverted T-guides and cross clips;

opposed internal T-guides integral to the side walls extending laterally into the interior space;

opposed external T-guides integral to the side walls;

opposed spaced L-brackets integral to the base wall extending laterally into the interior space;

at least one lighting fixture mounted within the interior space, a bulb mounted within the fixture;

a generally planar cover spanning the U-shaped opening proximate the upper margins of the side walls, opposed edges of said cover retained within the groove openings, said cover having a diffusion coefficient sufficient to allow light generated by the lighting fixture and bulb when powered to pass through said cover; and, wherein each of said T-guides, clips, groove openings, L-brackets, and cover runs the length of the extrusion.

12. The structure of claim 11, wherein the structure radiates a diffused light from the interior spaces.

13. The structure of claim 11, wherein at least one member supports a live load.

14. The structure of claim 11, wherein the members further comprise connector plates.

15. The structure of claim 11, further comprising a member having a cross-sectional shape selected from square, rectangular, triangular and/or curved.

16. The structure of claim 11, wherein select members are connected to form a corner assembly.

17. A method for constructing an internally illuminated architectural structure, said structure comprising a plurality of internally illuminated extrusion-based structural members, said members comprising:

a linear extrusion having a defined length and generally rectangular-shaped spaced left and right side walls, each of said side walls having a bottom edge, and an upper margin;

said side walls joined along their bottom edges by a center base wall to form a generally rectangular U-shaped opening defining an interior space;

opposed inverted T-guides integral to the upper margins of the side walls, said T-guides extending laterally into the interior space;

opposed cross clips integral to the side walls extending laterally into the interior space;

opposed groove openings integral to the side walls extending laterally into the interior space, said openings defined by the inverted T-guides and cross clips;

opposed internal T-guides integral to the side walls extending laterally into the interior space;

opposed external T-guides integral to the side walls;

opposed spaced L-brackets integral to the base wall extending laterally into the interior space;

at least one lighting fixture mounted within the interior space, a bulb mounted within the fixture;

a generally planar cover spanning the U-shaped opening proximate the upper margins of the side walls, opposed edges of said cover retained within the groove openings, said cover having a diffusion coefficient sufficient to allow light generated by the lighting fixture and bulb when powered to pass through said cover; and, wherein each of said T-guides, clips, groove openings, L-brackets, and cover runs the length of the extrusion;

wherein the method comprises the steps of:

connecting the members to form a desired structure;

mounting the covers; and, providing electric power to the lighting fixtures.

18. The method of claim 17, wherein the connecting step further comprises the steps of:

positioning a first member having a recessed connector plate relative to a second member having a protruding connector plate so as to align the recessed plate with the protruding plate;

inserting opposed spaced connector rails into the opposed internal T-guides of the first member, lowering the first member onto the second member and slidably engaging the rails into the internal T-guides of the second member;

inserting bolts on the recessed plate inside nuts on the protruding plate;

tightening the rails with a plurality of socket cap screws; and, tightening the bolts within the nuts.

19. The method of claim 17, further comprising one or more of the steps of:

attaching at least one post member to a base plate;

connecting an electric cord between the light fixtures;

tucking the cords inside a wire management tube; and, attaching a custom feature to a member selected from banner, fabric sheet, large scale graphic, shelf assembly, panel, fascia attachment, skin attachment, header, canopy, bar, storage tower, table, and workstation.

* * * * *